US010607466B2

(12) United States Patent
Rischar et al.

(10) Patent No.: US 10,607,466 B2
(45) **Date of Patent: *Mar. 31, 2020**

(54) METHOD TO CONFIGURE CONTROL SYSTEM ALARMS BY ASSOCIATING ALARMS TO TAGS

(71) Applicant: Rockwell Automation Technologies, Inc., Mayfield Heights, OH (US)

(72) Inventors: Charles Martin Rischar, Chardon, OH (US); Daniel Cernohorsky, Hradec Kralove (CZ); Petr Pitrinec, Cerveny Kostelec (CZ); Stephen C. Briant, Moon Township, PA (US); Douglas Brian Sumerauer, Concord, OH (US); Ho Lan Sabrina Chen, Kirtland, OH (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/530,421

(22) Filed: Aug. 2, 2019

(65) Prior Publication Data

US 2019/0355228 A1 Nov. 21, 2019

Related U.S. Application Data

(63) Continuation of application No. 15/983,995, filed on May 18, 2018, now Pat. No. 10,410,493.
(Continued)

(51) Int. Cl.
*G08B 19/00* (2006.01)
*G08B 31/00* (2006.01)
(Continued)

(52) U.S. Cl.
CPC ..... *G08B 19/00* (2013.01); *G08B 23/00* (2013.01); *G08B 31/00* (2013.01); *G08B 25/001* (2013.01); *G08B 25/008* (2013.01)

(58) Field of Classification Search
CPC ..... G08B 19/00; G08B 25/001; G08B 25/006
(Continued)

(56) References Cited

U.S. PATENT DOCUMENTS 10,410,493 B2 * 9/2019 Rischar ..... G08B 23/00

* cited by examiner

*Primary Examiner* — Daryl C Pope
(74) *Attorney, Agent, or Firm* — Amin, Turocy & Watson, LLP

(57) ABSTRACT

An alarm configuration system simplifies alarm management in industrial control systems by improving scalability and capacity of alarms. A control system device allows alarms to be configured by associating the alarm conditions with controller tags or other components of a control system. Properties of these alarm conditions can be referenced by external systems as well as programmatically as extensions of the associated controller tag or component. The alarm conditions are evaluated independently of the control program executed by the control device. A development system allows association of reusable user-defined alarm conditions with selected data types, such that the alarm conditions are automatically applied to controller tags of the selected data type. Selected alarm conditions can also be grouped into alarm sets, allowing operations to be performed collectively on the set of alarms. The system can also generate collective alarm statistics for the alarm conditions included in an alarm set.

20 Claims, 19 Drawing Sheets

Related U.S. Application Data

(60) Provisional application No. 62/516,872, filed on Jun. 8, 2017.

(51) Int. Cl.
*G08B 23/00* (2006.01)
*G08B 25/00* (2006.01)

(58) Field of Classification Search
USPC ..... 340/506, 3.1, 511, 514, 517
See application file for complete search history.

METHOD TO CONFIGURE CONTROL SYSTEM ALARMS BY ASSOCIATING ALARMS TO TAGS

CROSS-REFERENCE TO RELATED APPLICATIONS

This application is a continuation of, and claims priority to, U.S. patent application Ser. No. 15/983,995, filed on May 18, 2018, and entitled "METHOD TO CONFIGURE CONTROL SYSTEM ALARMS BY ASSOCIATING ALARMS TO TAGS," which claims priority to U.S. Provisional Application Ser. No. 62/516,872, filed on Jun. 8, 2017. The entireties of these related applications are incorporated herein by reference.

BACKGROUND

The subject matter disclosed herein relates generally to industrial control systems, and, more particularly, to configuration of alarms in industrial control systems

BRIEF DESCRIPTION

The following presents a simplified summary in order to provide a basic understanding of some aspects described herein. This summary is not an extensive overview nor is intended to identify key/critical elements or to delineate the scope of the various aspects described herein. Its sole purpose is to present some concepts in a simplified form as a prelude to the more detailed description that is presented later.

In one or more embodiments, an industrial control device is provided, comprising a program execution component configured to execute an industrial control program; a tag database component configured to maintain controller tags associated with the industrial control program; and an alarm processing component configured to, in response to receipt of alarm configuration data that defines an alarm condition and identifies a controller tag of the controller tags, create an association between the alarm condition and the controller tag, wherein the association causes the alarm condition to be a function of a value of the controller tag, the alarm processing component is further configured to, in response to a determination that the value of the controller tag satisfies the alarm condition, generate an alarm notification based on the association, and the alarm notification is accessible by an external application.

Also, one or more embodiments provide a method for configuring and evaluating industrial alarms, comprising receiving, by an industrial control device comprising a processor, alarm configuration data that defines an alarm condition and identifies a controller tag, of a set of controller tags defined on the industrial control device, to be associated with the alarm condition; in response to the receiving, creating, by the industrial control device, an association between the alarm condition and the controller tag, wherein the creating the association causes the alarm condition to be a function of a value of the controller tag; and in response to determining that the value of the controller tag satisfies the alarm condition, generating, by the industrial control device, an alarm notification in accordance with the association, wherein the alarm notification is accessible to an external application.

Also, according to one or more embodiments, a non-transitory computer-readable medium is provided having stored thereon instructions that, in response to execution, cause a system to perform operations, the operations comprising receiving alarm configuration data that defines an alarm condition and identifies a controller tag, of a set of controller tags defined on the industrial control device, to be associated with the alarm condition; in response to the receiving, creating an association between the alarm condition and the controller tag, wherein the creating the association causes the alarm condition to be a function of a value of the controller tag; and in response to determining that the value of the controller tag satisfies the alarm condition, generating an alarm notification in accordance with the association, wherein the alarm notification is accessible to an external application.

To the accomplishment of the foregoing and related ends, certain illustrative aspects are described herein in connection with the following description and the annexed drawings. These aspects are indicative of various ways which can be practiced, all of which are intended to be covered herein. Other advantages and novel features may become apparent from the following detailed description when considered in conjunction with the drawings.

DETAILED DESCRIPTION

Figure 1:
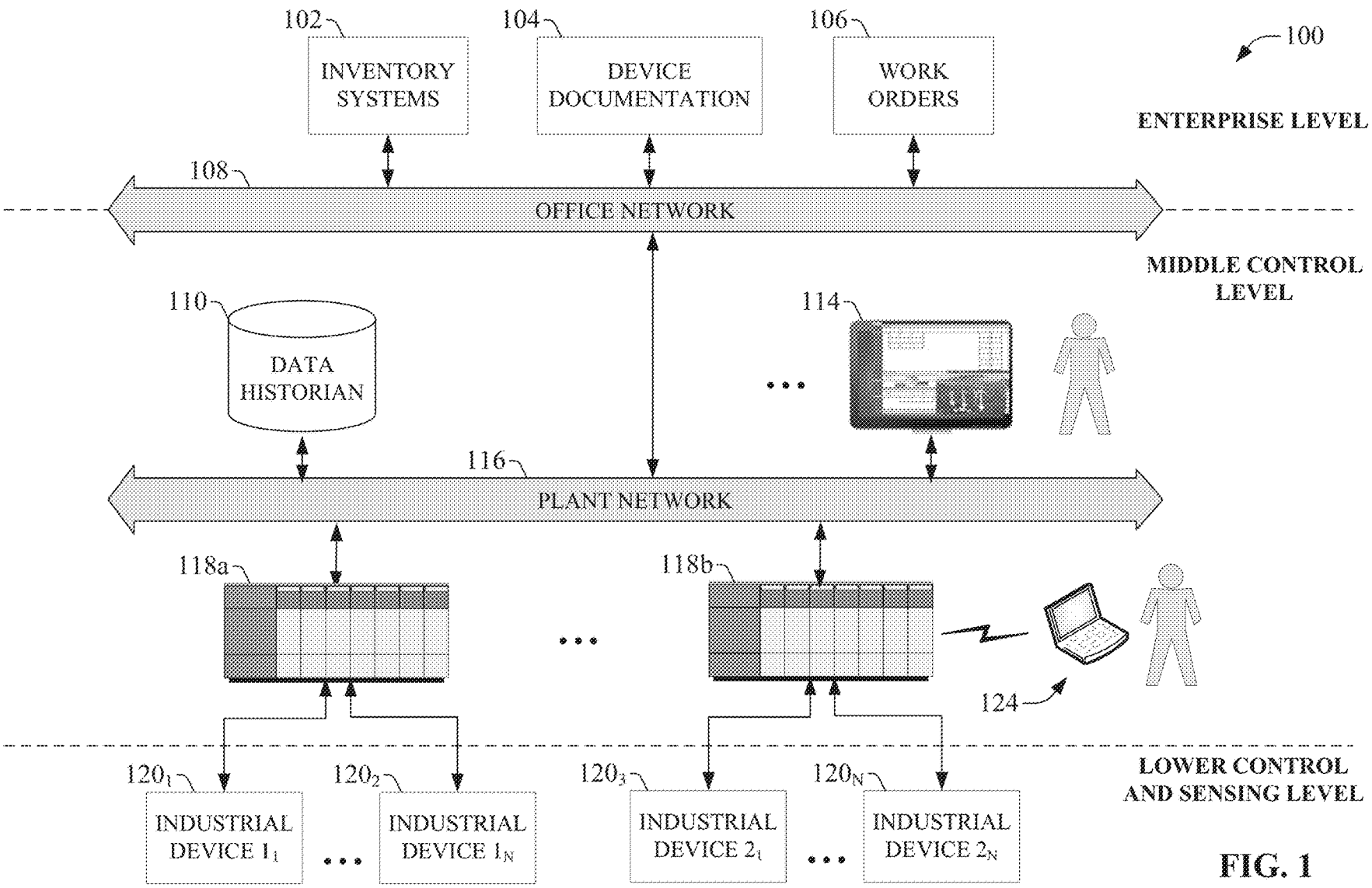
FIG. 1 is a block diagram of an example industrial control environment.

The subject disclosure is now described with reference to the drawings, wherein like reference numerals are used to refer to like elements throughout. In the following description, for purposes of explanation, numerous specific details are set forth in order to provide a thorough understanding thereof. It may be evident, however, that the subject disclosure can be practiced without these specific details. In other instances, well-known structures and devices are shown in block diagram form in order to facilitate a description thereof.

As used in this application, the terms "component," "system," "platform," "layer," "controller," "terminal," "station," "node," "interface" are intended to refer to a computer-related entity or an entity related to, or that is part of, an operational apparatus with one or more specific functionalities, wherein such entities can be either hardware, a combination of hardware and software, software, or software in execution. For example, a component can be, but is not limited to being, a process running on a processor, a processor, a hard disk drive, multiple storage drives (of optical or magnetic storage medium) including affixed (e.g., screwed or bolted) or removable affixed solid-state storage drives; an object; an executable; a thread of execution; a computer-executable program, and/or a computer. By way of illustration, both an application running on a server and the server can be a component. One or more components can reside within a process and/or thread of execution, and a component can be localized on one computer and/or distributed between two or more computers. Also, components as described herein can execute from various computer readable storage media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry which is operated by a software or a firmware application executed by a processor, wherein the processor can be internal or external to the apparatus and executes at least a part of the software or firmware application. As yet another example, a component can be an apparatus that provides specific functionality through electronic components without mechanical parts, the electronic components can include a processor therein to execute software or firmware that provides at least in part the functionality of the electronic components. As further yet another example, interface(s) can include input/output (I/O) components as well as associated processor, application, or Application Programming Interface (API) components. While the foregoing examples are directed to aspects of a component, the exemplified aspects or features also apply to a system, platform, interface, layer, controller, terminal, and the like.

As used herein, the terms "to infer" and "inference" refer generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

In addition, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Furthermore, the term "set" as employed herein excludes the empty set; e.g., the set with no elements therein. Thus, a "set" in the subject disclosure includes one or more elements or entities. As an illustration, a set of controllers includes one or more controllers; a set of data resources includes one or more data resources; etc. Likewise, the term "group" as utilized herein refers to a collection of one or more entities; e.g., a group of nodes refers to one or more nodes.

Various aspects or features will be presented in terms of systems that may include a number of devices, components, modules, and the like. It is to be understood and appreciated that the various systems may include additional devices, components, modules, etc. and/or may not include all of the devices, components, modules etc. discussed in connection with the figures. A combination of these approaches also can be used.

Industrial controllers and their associated I/O devices are central to the operation of modern automation systems. These controllers interact with field devices on the plant floor to control automated processes relating to such objectives as product manufacture, material handling, batch processing, supervisory control, and other such applications. Industrial controllers store and execute user-defined control programs to effect decision-making in connection with the controlled process. Such programs can include, but are not limited to, ladder logic, sequential function charts, function block diagrams, structured text, or other such platforms.

FIG. 1 is a block diagram of an example industrial control environment 100. In this example, a number of industrial controllers 118 are deployed throughout an industrial plant environment to monitor and control respective industrial systems or processes relating to product manufacture, machining, motion control, batch processing, material handling, or other such industrial functions. Industrial controllers 118 typically execute respective control programs to facilitate monitoring and control of industrial devices 120 making up the controlled industrial systems. One or more industrial controllers 118 may also comprise a soft controller executed on a personal computer or other hardware platform, or on a cloud platform. Some hybrid devices may also combine controller functionality with other functions (e.g., visualization). The control programs executed by industrial controllers 118 can comprise any conceivable type of code used to process input signals read from the industrial devices 120 and to control output signals generated by the industrial controllers, including but not limited to ladder logic, sequential function charts, function block diagrams, or structured text. These control programs are typically developed by a designer using a suitable controller configuration application and downloaded to the controller using a client device 124

Industrial devices 120 may include both input devices that provide data relating to the controlled industrial systems to the industrial controllers 118, and output devices that respond to control signals generated by the industrial controllers 118 to control aspects of the industrial systems. Example input devices can include telemetry devices (e.g., temperature sensors, flow meters, level sensors, pressure sensors, etc.), manual operator control devices (e.g., push buttons, selector switches, etc.), safety monitoring devices (e.g., safety mats, safety pull cords, light curtains, etc.), and other such devices. Output devices may include motor drives, pneumatic actuators, signaling devices, robot control inputs, valves, and the like.

Industrial controllers 118 may communicatively interface with industrial devices 120 over hardwired or networked connections. For example, industrial controllers 118 can be equipped with native hardwired inputs and outputs that communicate with the industrial devices 120 to effect control of the devices. The native controller I/O can include digital I/O that transmits and receives discrete voltage signals to and from the field devices, or analog I/O that transmits and receives analog voltage or current signals to and from the devices. The controller I/O can communicate with a controller's processor over a backplane such that the digital and analog signals can be read into and controlled by the control programs. Industrial controllers 118 can also communicate with industrial devices 120 over a network using, for example, a communication module or an integrated networking port. Exemplary networks can include the Internet, intranets, Ethernet, DeviceNet, ControlNet, Data Highway and Data Highway Plus (DH/DH+), Remote I/O, Fieldbus, Modbus, Profibus, wireless networks, serial protocols, and the like. The industrial controllers 118 can also store persisted data values that can be referenced by the control program and used for control decisions, including but not limited to measured or calculated values representing operational states of a controlled machine or process (e.g., tank levels, positions, alarms, etc.) or captured time series data that is collected during operation of the automation system (e.g., status information for multiple points in time, diagnostic occurrences, etc.). Similarly, some intelligent devices—including but not limited to motor drives, instruments, or condition monitoring modules—may store data values that are used for control and/or to visualize states of operation. Such devices may also capture time-series data or events on a log for later retrieval and viewing.

Figure 2:
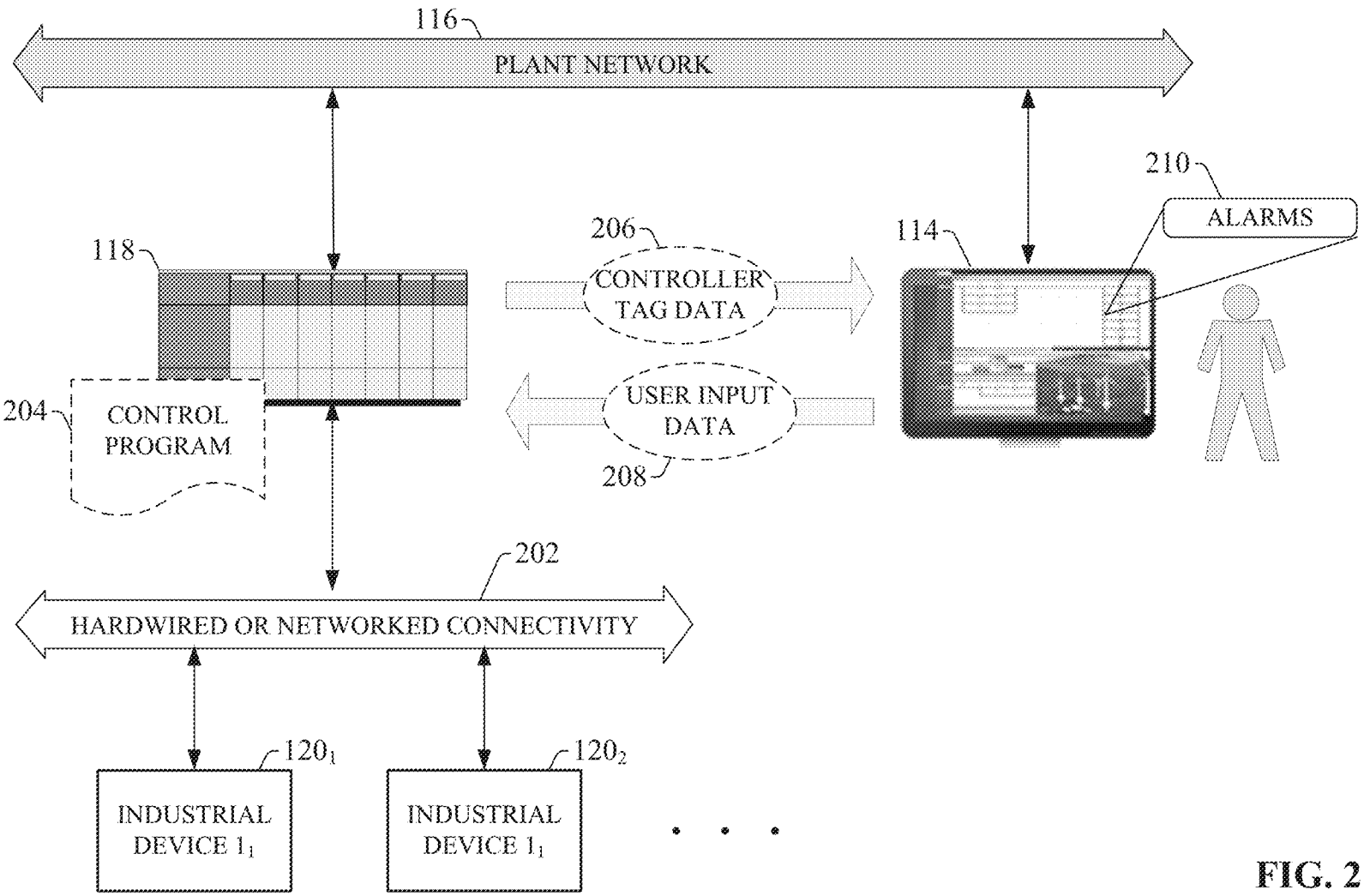
FIG. 2 is a diagram illustrating a general relationship between an industrial controller and an HMI.

Industrial automation systems often include one or more human-machine interfaces (HMIs) 114 that allow plant personnel to view telemetry and status data associated with the automation systems, and to control some aspects of system operation. FIG. 2 is a diagram illustrating a general relationship between an industrial controller 118 and an HMI 114. In an example architecture, an HMI 114 may communicate with one or more of the industrial controllers 118 over a plant network 116 (or via a direct connection), and exchange data with the industrial controllers to facilitate visualization of information relating to the controlled industrial processes on one or more pre-developed operator interface screens. To this end, HMI 114 may be configured to read controller tag data 206 from the industrial controller's tag database, the controller tag data 206 representing analog and digital values associated with data tags defined as part of the controller's configuration. Controller tag data 206 can include data associated with I/O tags representing current values of the controller's digital and analog inputs and outputs, as well as data associated with user-defined tags that are updated in accordance with control program 204. Controller tag data 206 can also include diagnostic data read from system-defined diagnostic tags that are updated by the controller's own diagnostic routines. HMIs 114 can also be configured to allow operators to submit data 208 to specified data tags or memory addresses of the industrial controllers 118, thereby providing a means for operators to issue commands to the controlled systems (e.g., cycle start commands, device actuation commands, etc.), to modify setpoint values, etc.

HMIs 114 can generate one or more display screens through which the operator interacts with the industrial controllers 118, and thereby with the controlled processes and/or systems. The display screens can visualize present states of industrial systems or their associated devices using graphical objects that display metered or calculated values, employ color or position animations based on state, render alarm notifications, or employ other such techniques for presenting relevant data to the operator. Data presented in this manner is read from industrial controllers 118 by HMIs 114 as controller tag data 206 and presented on one or more of the display screens according to display formats chosen by the HMI developer. HMIs 114 may comprise fixed or mobile devices that execute either user-installed or pre-installed operating systems, and either user-installed or pre-installed graphical application software.

Figure 3:
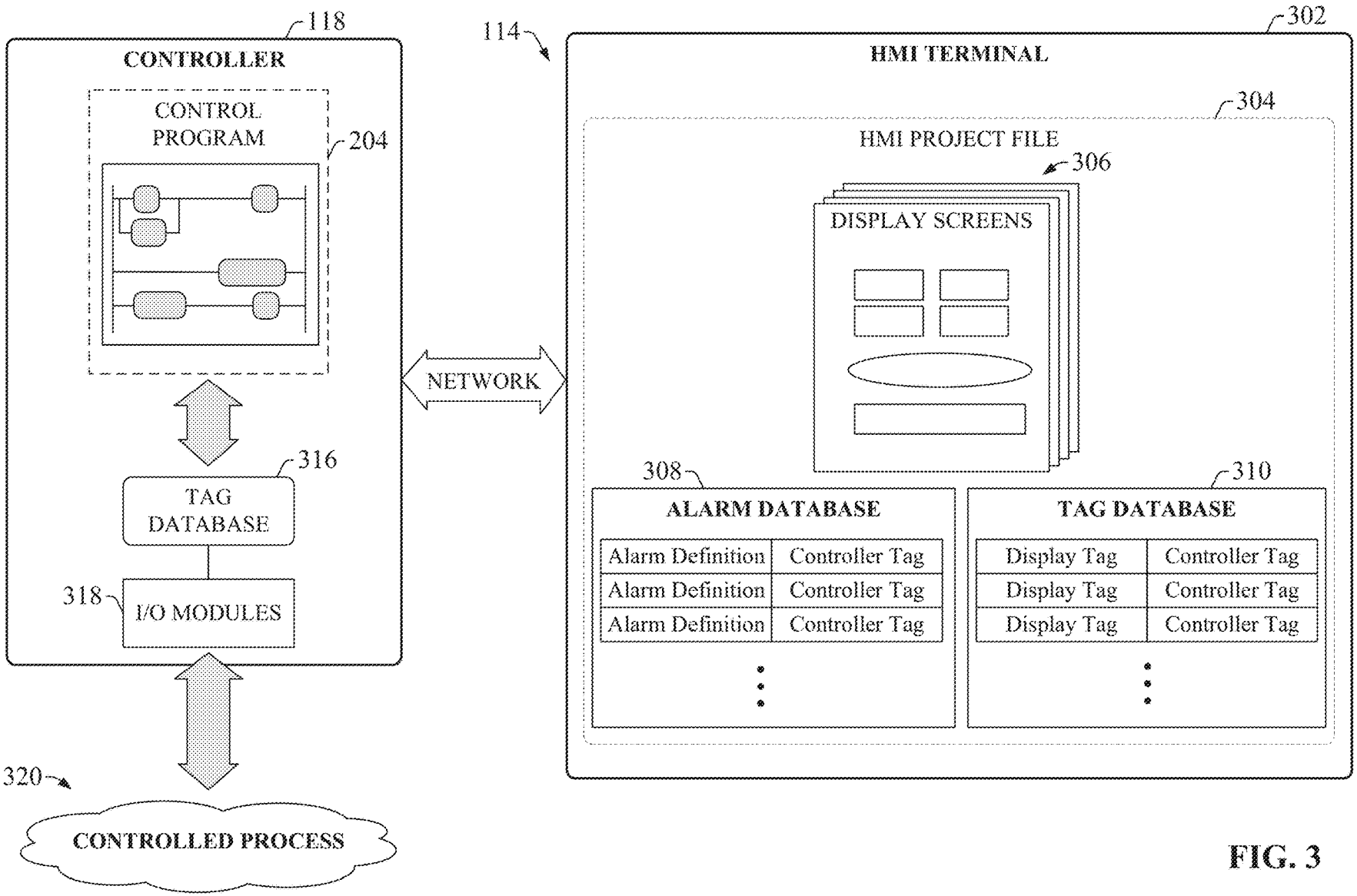
FIG. 3 is a generalized diagram illustrating components of an example HMI project that executes on an HMI terminal and interfaces with an industrial controller.

In addition to rendering operational and status information, HMIs are typically configured to generate and display alarm notifications 210 in response to a detected abnormal or fault within the controlled system, machine, or process. These alarms are typically configured within the HMI's project file or on an external server. FIG. 3 is a generalized diagram illustrating components of an example HMI project that executes on an HMI terminal device 302 and interfaces with an industrial controller 118. Controlled industrial process 320 can represent any industrial process, machine, or system being monitored and controlled by industrial controller 118 (via industrial devices 120). Industrial controller 118 includes one or more I/O modules 318 that provide the hardwired or networked connectivity to the controlled equipment and telemetry devices that make up the controlled industrial process 320. These I/O modules 318 can include, for example, digital and/or analog input modules, digital and/or analog output modules, networking modules, or the like. A controller tag database 316 configured on the controller's memory can store current analog and digital values of the various inputs and outputs read from or written to the I/O modules 318. That is, data values read from field devices by I/O modules 318 (e.g., analog or digital input modules) are written to the controller tag database 316. These input values can then be read by control program 204 which updates its control variables accordingly. Similarly, output values generated by the control program 204 are written to controller tag database 316, causing corresponding output data signals to be generated by analog or digital output modules of the I/O modules 318.

Control program 204 can also update values of user-defined controller tags defined in the controller tag database 316, including but not limited to internal program variables or bits, setpoint values, calculated values or calculated status bits, or other such data.

In general, controller tags are data structures that reference a data item or memory location within the controller 118 (e.g., an input value, an output value, or an internal data register). A controller tag can be configured to be an instance of a specified data type, such as binary, floating point, integer, double integer, string, etc. These controller tags are typically defined during configuration and programming of the controller 118.

HMI 114 comprises an HMI terminal device 302 that executes an HMI project file 304. The HMI project file 304 defines the display screens 306 and configuration settings for the HMI (e.g., communication parameters for communicating with controller 118, display preferences, etc.). Each of the display screen 306 hosts static and/or dynamic content that renders, in textual or graphical format, values of selected controller tags representing states of the controlled process 320. One or more of the defined display screens 306 can also include interactive objects that allow an operator to enter a value to be written to a selected one of the controller tags, or to set/reset a bit within the controller 118 (e.g. issue a start or stop command to a device via the control program).

HMI project file 304 also includes an alarm database 308 that defines one or more conditions that will trigger an alarm display on the HMI 114. Alarm database 308 defines each abnormal condition for which an alarm message is to be generated, as well as the industrial controller tag (or combination of tags) that controls the ON and OFF states of each alarm. According to this configuration, evaluation of each alarm's state is performed by the HMI 114 or an external server based on status information read from the controller tag database 316 (e.g., via network 116). Since alarms are viewed and managed via the HMI 114 or external server, it is difficult to suppress alarms from the control application itself.

In other example alarm configurations, alarm instructions can be programmed as part of the control program 204 executing on the industrial controller 118, and alarm detection processing can be performed on the industrial controller 118 rather than on the HMI 114. This technique eliminates the need for the HMI 114 to read controller tag data from the industrial controller 118, and may be more reliable than evaluating alarm conditions in the HMI 114. However, configuring alarms within the control application executing on the industrial controller 118 can detrimentally impact execution of the control program 204 as a result of the additional processing resources required to process the alarms, thereby adversely impacting real-time control latency. Moreover, in order to add or remove alarm conditions using this approach, the user must edit the control program 204, either by modifying the control program offline and downloading the modified program to the industrial controller 118 or by interfacing with the industrial controller 118 using a configuration application and modifying the control program 204 online.

To address these and other issues, various embodiments described herein provide systems and methods that simplify alarm management in industrial control systems. These systems and methods can also improve scalability and capacity of alarms within control systems. In one or more embodiments, a control system device (e.g., an industrial controller 118 or other control device) allows control system alarm conditions to be defined and associated with controller tags or other components of the control system being monitored. Alarm conditions that are associated with controller tags or components can be referenced by external systems (e.g., HMIs, program development applications, or other external systems) as extensions of their associated controller tag or component. This technique can simplify management of alarms during commissioning and operation of the control equipment. For example, this technique allows additional alarms to be added and configured, or alarms that are no longer needed to be deleted, without the need to edit the industrial control program 204 or other control application. Moreover, since the alarm conditions are not programmed as a direct part of the control program 204 executed by the industrial controller 118, alarm conditions are evaluated independently of the control application (e.g., in a separate execution thread relative to the control application) and thus do not impact performance of real-time control.

Figure 4:
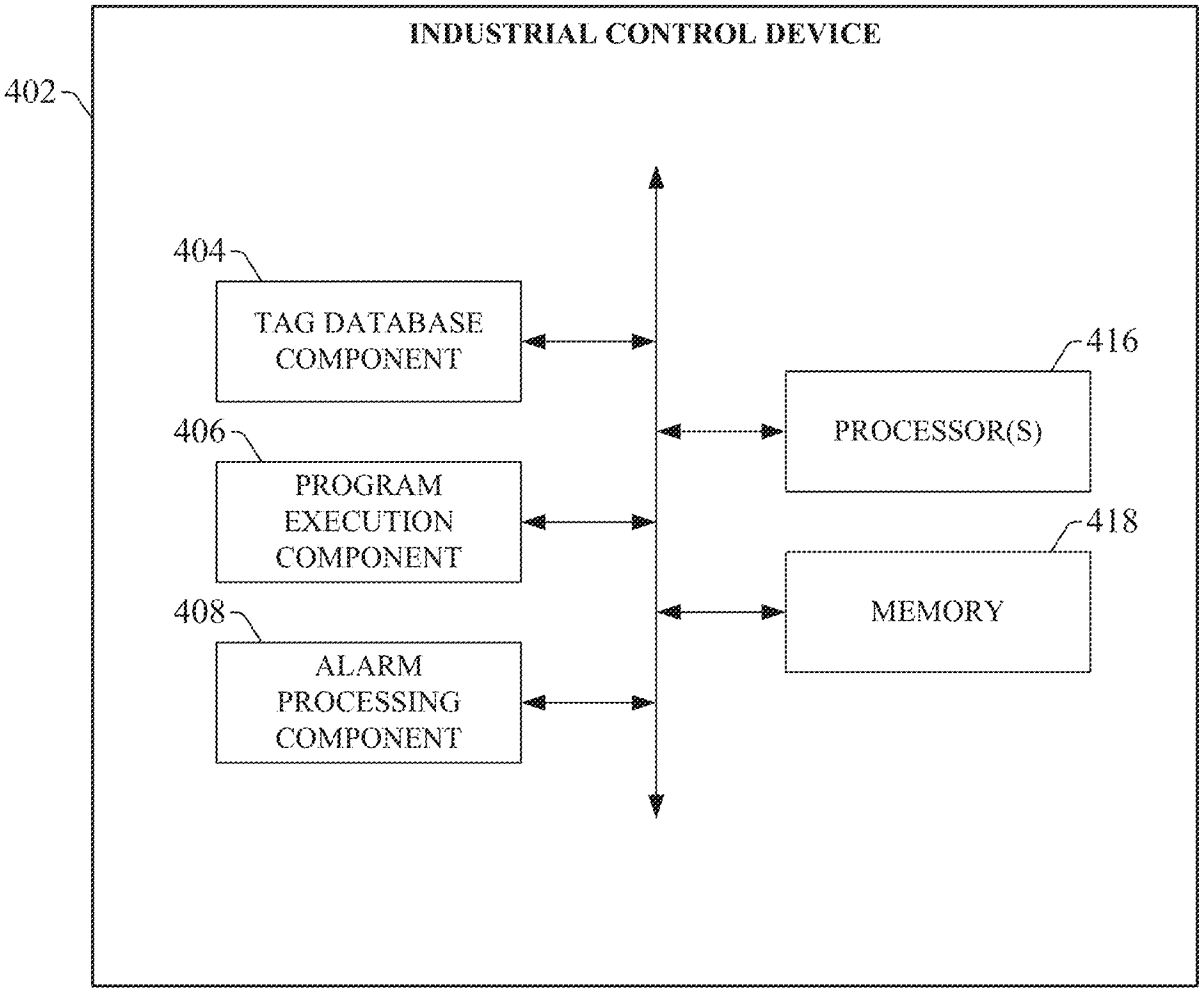
FIG. 4 is a block diagram of an example industrial control device.

FIG. 4 is a block diagram of an example industrial control device 402 according to one or more embodiments of this disclosure. Aspects of the systems, apparatuses, or processes explained in this disclosure can constitute machine-executable components embodied within machine(s), e.g., embodied in one or more computer-readable mediums (or media) associated with one or more machines. Such components, when executed by one or more machines, e.g., computer(s), computing device(s), automation device(s), virtual machine(s), etc., can cause the machine(s) to perform the operations described. Industrial control device 402 can be, for example, an industrial controller such as a PLC, a motor drive, or other type of control system device.

Industrial control device 402 can include a tag database component 404, a program execution component 406, an alarm processing component 408, one or more processors 416, and memory 418. In various embodiments, one or more of the tag database component 404, program execution component 406, alarm processing component 408, the one or more processors 416, and memory 418 can be electrically and/or communicatively coupled to one another to perform one or more of the functions of the control device 402. In some embodiments, components 404, 406, and 408 can comprise software instructions stored on memory 418 and executed by processor(s) 416. Control device 402 may also interact with other hardware and/or software components not depicted in FIG. 4. For example, processor(s) 416 may interact with one or more external user interface devices, such as a keyboard, a mouse, a display monitor, a touchscreen, or other such interface devices.

Tag database component 404 can be configured to maintain a database of controller tags associated with the control device 402 and used to store or address data items in connection with monitoring and control of an industrial machine, system, or process. The controller tags can include tags corresponding to different data types, including but not limited to analog data tags (e.g., integer, real, or double data tags), digital data tags, string data tags, or other such tags. Some controller tags are configured to store data values corresponding to respective analog or digital inputs or outputs of the control device 402. Other controller tags can be configured to store data values that are generated and used internally by the control program executed by the control device 402. Controller tags can be added to the tag database and configured by a user using a suitable configuration application that interfaces with the control device 402.

Program execution component 406 can be configured to execute a user-defined control program (e.g., control program 204) designed to monitor and control an industrial system, machine, or process via the control device's I/O (e.g., I/O modules or native hardwired inputs and outputs). Alarm processing component 408 can be configured to generate alarm notifications for alarm conditions that are associated with selected controller tags, data types, or other control objects. The one or more processors 416 can perform one or more of the functions described herein with reference to the systems and/or methods disclosed. Memory 418 can be a computer-readable storage medium storing computer-executable instructions and/or information for performing the functions described herein with reference to the systems and/or methods disclosed.

Figure 5:
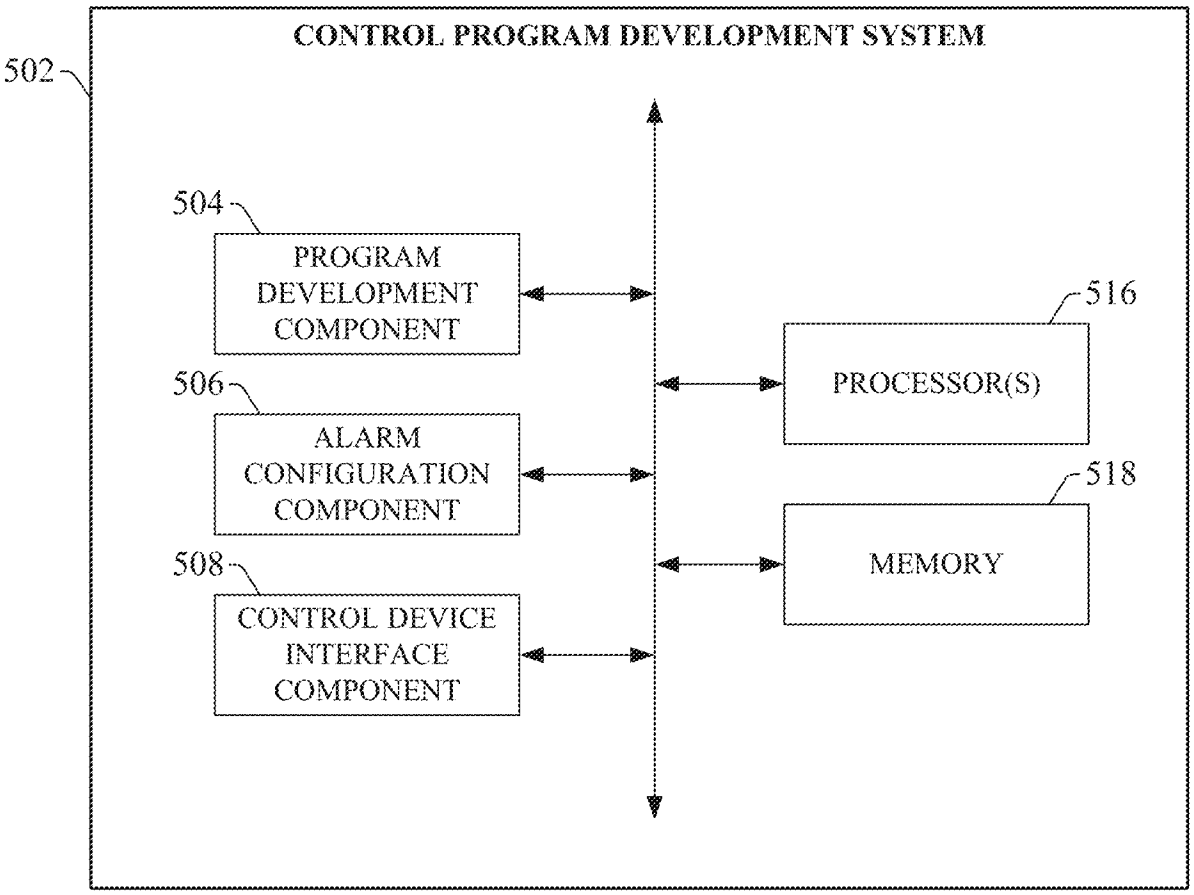
FIG. 5 is a block diagram of an example control program development system that can be used to associate alarm conditions and alarm sets with controller tags.

FIG. 5 is a block diagram of an example control program development system 502 that can be used to associate alarm conditions and alarm sets with controller tags according to one or more embodiments of this disclosure. Control program development system 502 can include a program development component 504, an alarm execution component 506, a control device interface component 508, one or more processors 516, and memory 518. In various embodiments, one or more of the program development component 504, alarm execution component 506, control device interface component 508, the one or more processors 516, and memory 518 can be electrically and/or communicatively coupled to one another to perform one or more of the functions of the control program development system 502. In some embodiments, components 504, 506, and 508 can comprise software instructions stored on memory 518 and executed by processor(s) 516. Control program development system 502 may also interact with other hardware and/or software components not depicted in FIG. 5. For example, processor(s) 516 may interact with one or more external user interface devices, such as a keyboard, a mouse, a display monitor, a touchscreen, or other such interface devices.

Program development component 504 can be configured to generate a control program for execution on an industrial control device (e.g., industrial control device 402, which may be an industrial controller such as a PLC or another type of industrial control device) based on programming input provided by a user (e.g., a ladder logic program, sequential function chart input, etc.). Alarm configuration component 506 can be configured to generate alarm configuration data to be associated with the control program during development of the control program. Alarm configuration component 506 can generate this alarm configuration data in accordance with user input specifying user-defined alarm conditions, or may generate some or all of this alarm configuration data automatically based on the content of the control program, the controller tags defined for the control device 402, or an organizational hierarchy of the control program. The control device interface component 508 can be configured to establish communication with the control device 402 so that controller configuration data, including the control program and associated tag and alarm conditions, can be downloaded to the control device 402. Communication established by the control device interface component 508 can also allow the user to monitor runtime data generated by the control device within the program development environment.

The one or more processors 516 can perform one or more of the functions described herein with reference to the systems and/or methods disclosed. Memory 518 can be a computer-readable storage medium storing computer-executable instructions and/or information for performing the functions described herein with reference to the systems and/or methods disclosed.

Figure 6:
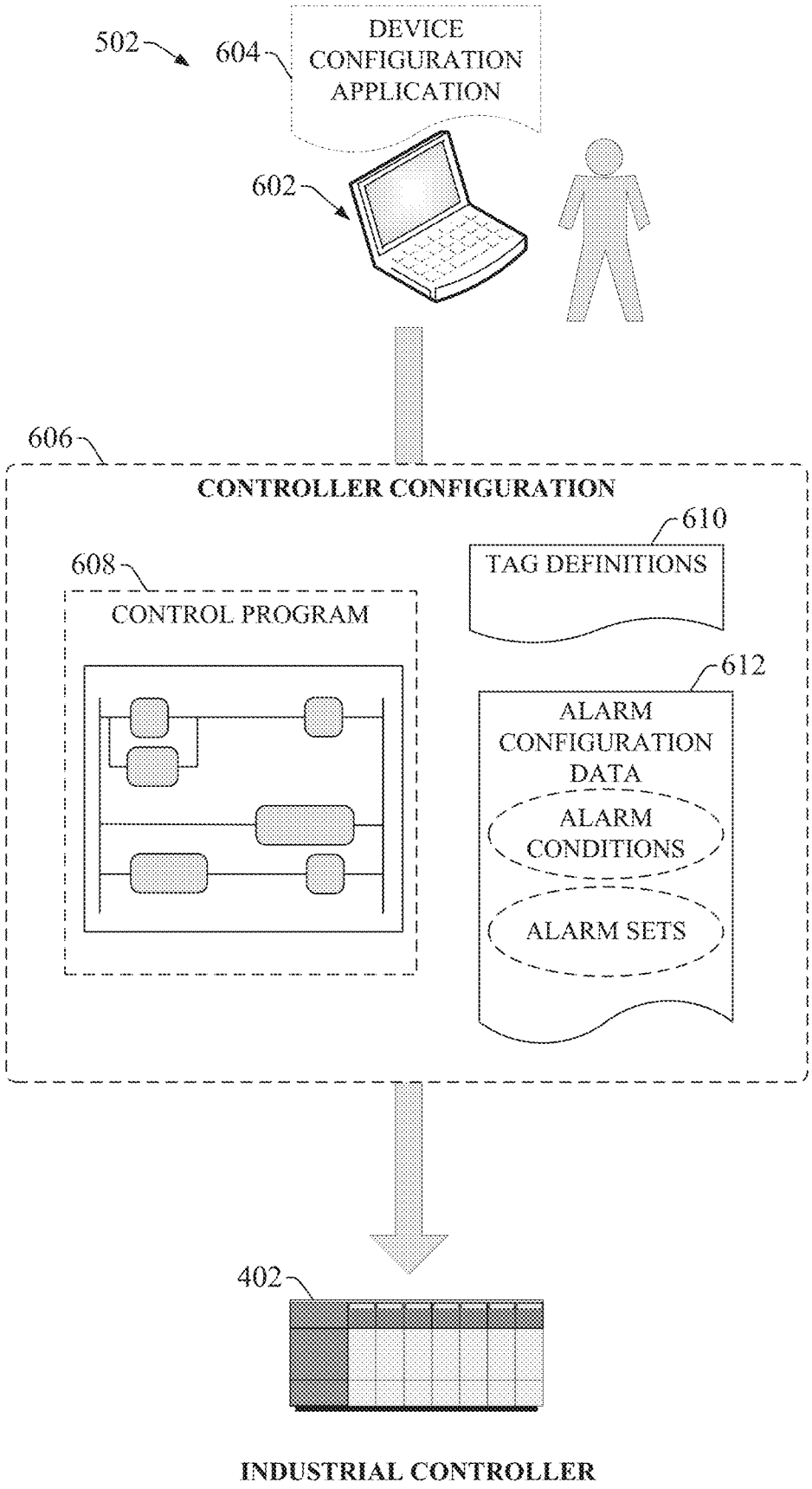
FIG. 6 is a diagram illustrating configuration of an industrial control device using a control program development system, including configuration of alarm conditions and alarm sets.

FIG. 6 is a diagram illustrating configuration of an industrial control device 402 using control program development system 502, including configuration of alarm conditions and alarm sets, according to one or more embodiments. In this example scenario, control program development system 502 comprises a client device 602 (e.g., a laptop computer, a desktop computer, a tablet computer, a personal mobile device, etc.) that executes a device configuration application 604 that facilitates programming and configuration of industrial control device 402. In the examples described herein, control device 402 is an industrial controller such as a PLC or other type of programmable automation controller. However, the alarm condition configuration and processing functions described herein are not limited to implementation on industrial controllers, and can also be implemented on other types of industrial devices without departing from the scope of one or more embodiments of this disclosure.

In general, device configuration application 604 generates and downloads controller configuration data 606 to the industrial control device 402 in accordance with user-defined programming and configuration settings. This controller configuration data 606 can include at least a control program 608, tag definitions 610, and alarm configuration data 612. Device configuration application 604 executes a programming environment that allows a developer to generate a control program 608 to be executed on industrial control device 402. As described above, control program 608 can be written as a ladder logic program, one or more sequential function charts, one or more function block diagrams, structured text, or another type of control program.

Device configuration application 604 also includes configuration tools that allow the developer to generate tag definitions 610 defining the controller tags that will be used by the control program 608. These tags can include digital and analog I/O tags as well as tags corresponding to digital, numerical, or string values that are calculated or set by the control program 608 or by the control device's internal diagnostic processing. Each controller tag is an instance of a designated data type (e.g., binary, floating point, integer, double integer, string, etc.). When downloaded to the control device 402 as part of controller configuration data 606, the control device's tag database component 404 configures the device's tag database in accordance with the tag definitions 610.

Alarm configuration data 612 defines alarm conditions to be associated with selected controller tags (that is, selected tags defined by tag definitions 610), data types, or other control objects. Alarm configuration data 612 can also define sets of alarm conditions that are to be grouped together and processed collectively as alarm sets, as will be described in more detail herein. At least some of alarm configuration data 612 can be generated based on user-defined alarm configurations and tag associations. In some embodiments, some or all of alarm configuration data can also be generated automatically during program development.

Figure 7:
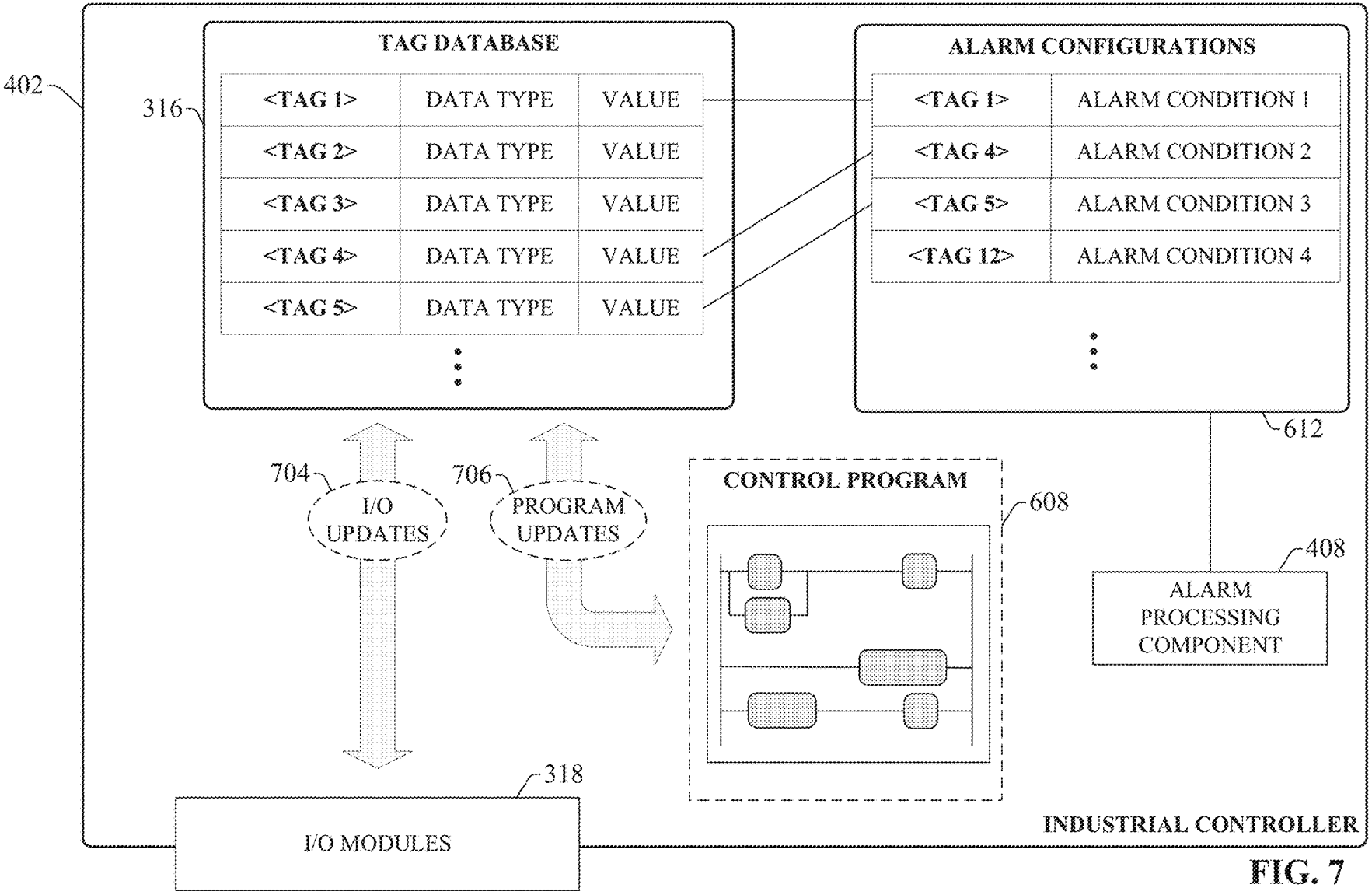
FIG. 7 is a diagram illustrating the relationship between controller tags defined in a tag database and alarm conditions defined for a control device.

FIG. 7 is a diagram illustrating the relationship between controller tags defined in the tag database 316 and alarm conditions defined for the control device 402 by alarm configuration data 612. In this example, tag database 316 defines controller tags that store data values in connection with execution of control program 608, as well as internal data tags whose values are updated by the control device's internal diagnostics. Each entry of the tag database 316 corresponds to a controller tag. For each controller tag, the tag database 316 defines metadata about the tag, such as the tag's data type (e.g., binary, real, integer, string, a user-defined data type, etc.), as well as the current value of the tag. The values of some controller tags are updated based on program updates 706 generated by the control program 608 (e.g., when a bit is set or reset by the program 608, or if an analog or string value is modified by the program 608). Controller tags corresponding to digital or analog inputs are updated based on I/O updates 704 from the control device's I/O modules 318 (or other type of I/O associated with the control device, such as remote or networked I/O). Control program 608 also reads controller tag values from the tag database 316 so that tags that serve as control program variables are kept up-to-date during program execution. Values of controller tags corresponding to digital or analog outputs are used to control output signals of corresponding outputs of I/O modules 318. In general, updates to the controller tag values are managed by tag database component 404 based on execution of the control program 608 and the control device's I/O.

In addition to the tag database 316, control device 402 maintains alarm configuration data 612 that defines alarm conditions and their associations with one or more of the controller tags defined in the tag database 316. These associations between alarm conditions and selected controller tags can be set by the developer using device configuration application 604, and may be either defined by a user or generated automatically based on the control program (e.g., based on the project structure of the control program, such that the alarm sets reflect the organizational hierarchy of the control program). The alarm configuration component 506 of device configuration application 604 can allow alarm conditions to be indirectly associated with controller tags defined in the tag database. An alarm condition defines the conditions under which an alarm will be generated as a function of its associated controller tag. For example, the alarm condition associated with a given controller tag may define that an alarm notification is to be generated when a value of the controller tag exceeds a defined setpoint specified by the alarm condition, or when another state of the controller tag corresponds to an alarm state specified by the alarm condition.

In the example illustrated in FIG. 7, a first alarm conditions (Alarm Condition 1) has been associated with Tag 1 in the tag database 316. Tags 4, 5, and 12 have also been associated with respective alarm conditions. These alarm conditions define the conditions under which an alarm notification will be generated, where the alarm condition is defined as a function of the state or value of the controller tag with which the alarm condition is associated. As will be described in more detail below, association of an alarm condition with a controller tag allows properties of the alarm condition to be accessible as an extended member of its associated controller tag.

Figure 8:
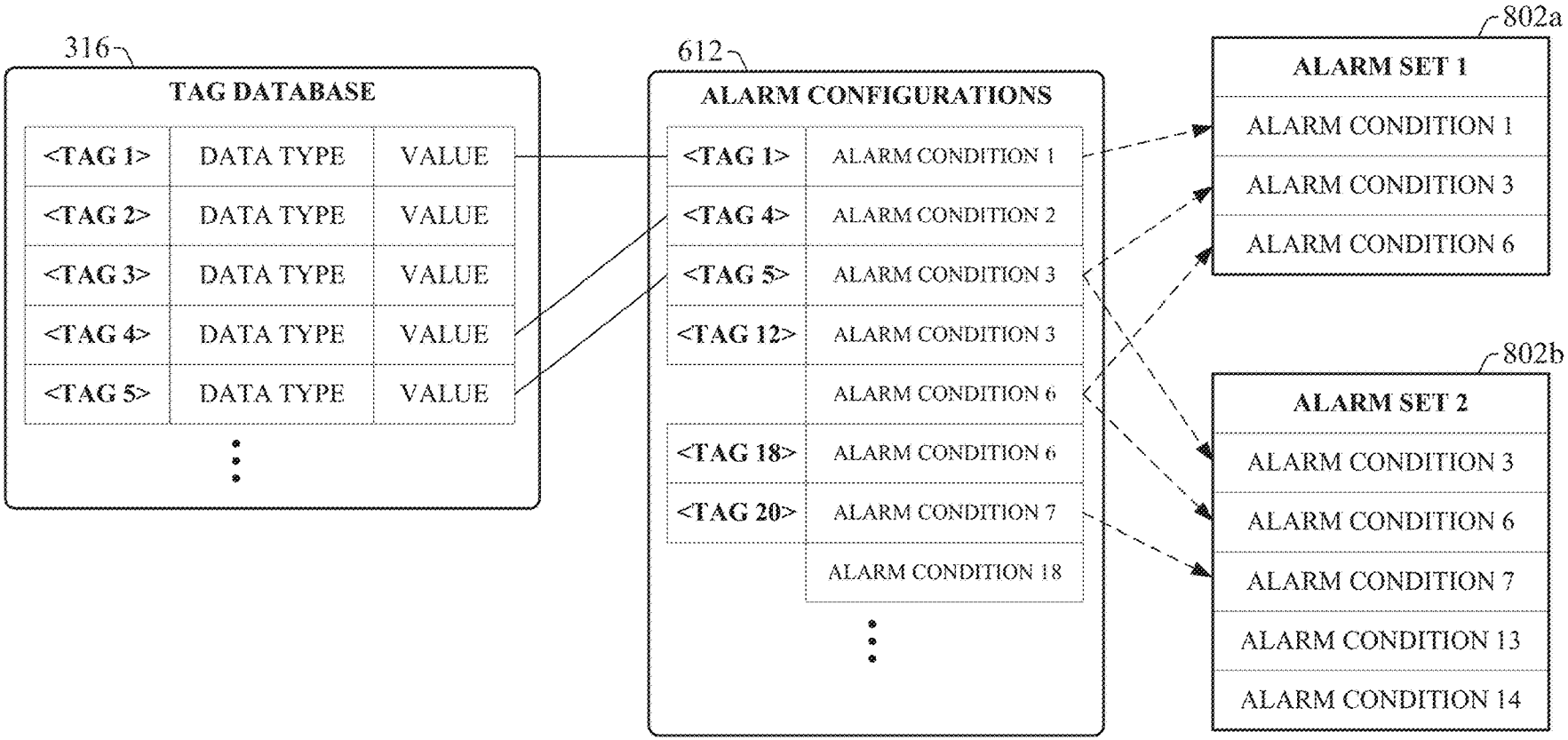
FIG. 8 is a diagram illustrating a relationship between alarm conditions and alarm sets.

Control program development system 502 can also support definition of alarm sets comprising multiple alarm conditions that can be acted upon as a group. FIG. 8 is a diagram illustrating the relationship between alarm conditions and alarm sets. In this example, a number of controller tags defined in tag database 316 have been associated with respective alarm conditions, as defined by alarm configuration data 612. For example, controller tags 1, 4, and 5 have been associated with alarm conditions 1, 2, and 3, respectively. Some controller tags, such as tags 12 and 20, have each been associated with more than one alarm condition, while other controller tags (e.g., tags 2 and 3) have not been associated with any alarm conditions. Note that some alarm conditions have been assigned to multiple controller tags. For example, alarm condition 3 has been assigned to both controller tag 5 and controller tag 12.

In addition, a number of alarm sets 802 have been defined, where each alarm set 802 comprises multiple alarm conditions that have been grouped together for the purposes of collective alarm operations and rollup information (to be described in more detail below). For clarity, only two example alarm sets 802*a* and 802*b* are shown in FIG. 8. However, the system allows any number of alarm sets 802 to be defined. Alarm sets 802 allow related alarm conditions to be grouped together and acted on as a collective unit. In the illustrated example, Alarm Set 1 (802*a*) comprises three alarm conditions (alarm conditions 1, 3, and 6), while Alarm Set 2 (802*b*) comprises five alarm conditions (alarm conditions 3, 6, 7, 13, and 14).

As will be described in more detail below, alarm processing component 408 can generate rollup information for each defined alarm set 802. This rollup information comprises aggregated statistics regarding the states of the alarm conditions that make up the alarm set. Alarm sets 802 also allow operations—such as alarm acknowledgement operations—to be applied to all alarms in the alarm set 802 in response to a single operator or programmatic action.

Control system developers often wish to use the same alarm conditions on multiple alarms, as in scenarios in which the same type of alarm is applied to different control objects (e.g., different pumps, different brewing vats, etc.). For example, some alarm conditions may be configured to trigger a high temperature alarm when the temperature exceeds a first setpoint, a high-high temperature alarm when the temperature exceeds a second (higher) setpoint, a low temperature alarm when the temperature falls below a third setpoint lower than the high and high-high setpoints, and a low-low temperature alarm when the temperature falls below a fourth setpoint lower than the first, second, and third setpoints. This same alarm condition may be required for several different control objects that make up a control project. In such scenarios, control system designers typically must manually reenter the same configurations and alarms into the development system for different objects (e.g., tags, add-on instructions, function blocks, etc.)

To address this issue, the alarm configuration component 506 can allow an alarm condition to be reused and reapplied to multiple objects, thereby mitigating the need to enter the same alarm configuration multiple times for different objects to be monitored. These reusable alarm conditions can be created offline and downloaded to the control device 402 as part of controller configuration data 606, or may be created online during runtime of the control device 402. Once defined, an alarm condition can be assigned as needed to individual tags or to an alarm set 802. In the example depicted in FIG. 8, alarm condition 3 is assigned as the alarm condition associated with both controller tag 5 and controller tag 12, and is also a member of both Alarm Set 1 and Alarm Set 2. Any number of alarm conditions can be associated with a given tag, each alarm condition relating to a different concern that an operator should be notified about via an alarm notification display. Moreover, each alarm condition can be assigned to any number of alarm sets 802.

In some embodiments, alarm configuration component 506 can allow reusable alarm conditions to be associated with any data type within the control program project, including but not limited to system-defined data types, user-defined data types, and module-defined data types. Reusable alarm conditions can also be associated with add-on instruction definitions. When an alarm condition is created and associated with a selected data type, alarm configuration component 506 can apply the alarm condition to all controller tags within the project that are instances of the selected data type. This can include associating the alarm condition to pre-existing controller tags of the selected data type, as well as automatically assigning the alarm condition to controller tags conforming to the selected data type that are created after the alarm condition has been created. In this way, a developer can define an alarm condition that will be applied to multiple control objects of a selected data type throughout a control project, and the development system 502 will apply this pre-defined alarm condition to controller tags conforming to the data type as appropriate. The ability to reuse defined alarm conditions across multiple controller tags can eliminate the need to define a common alarm condition multiple times across many controller tags.

In some embodiments, alarm configuration component 506 can automatically create and assign an alarm set 802 to a controller tag during program development based on the controller tag's data type (e.g., a user-defined data type or a system-defined data type). In this regard, each controller tag of a given data type can be considered an instance of that data type. An alarm set 802 can be defined and associated with a selected data type, such that the alarm configuration component 506 will automatically assign that alarm set 802 to each controller tag corresponding to the data type. When an alarm set 802 is associated with a data tag, all alarm conditions associated with the tag will be associated with the alarm set 802. In some embodiments, alarm conditions or alarm sets can also be associated with other components of a control system, including but not limited to I/O modules, programs, motion control axes, add-on instructions (AOIs), or a built-in instruction.

Figure 9:
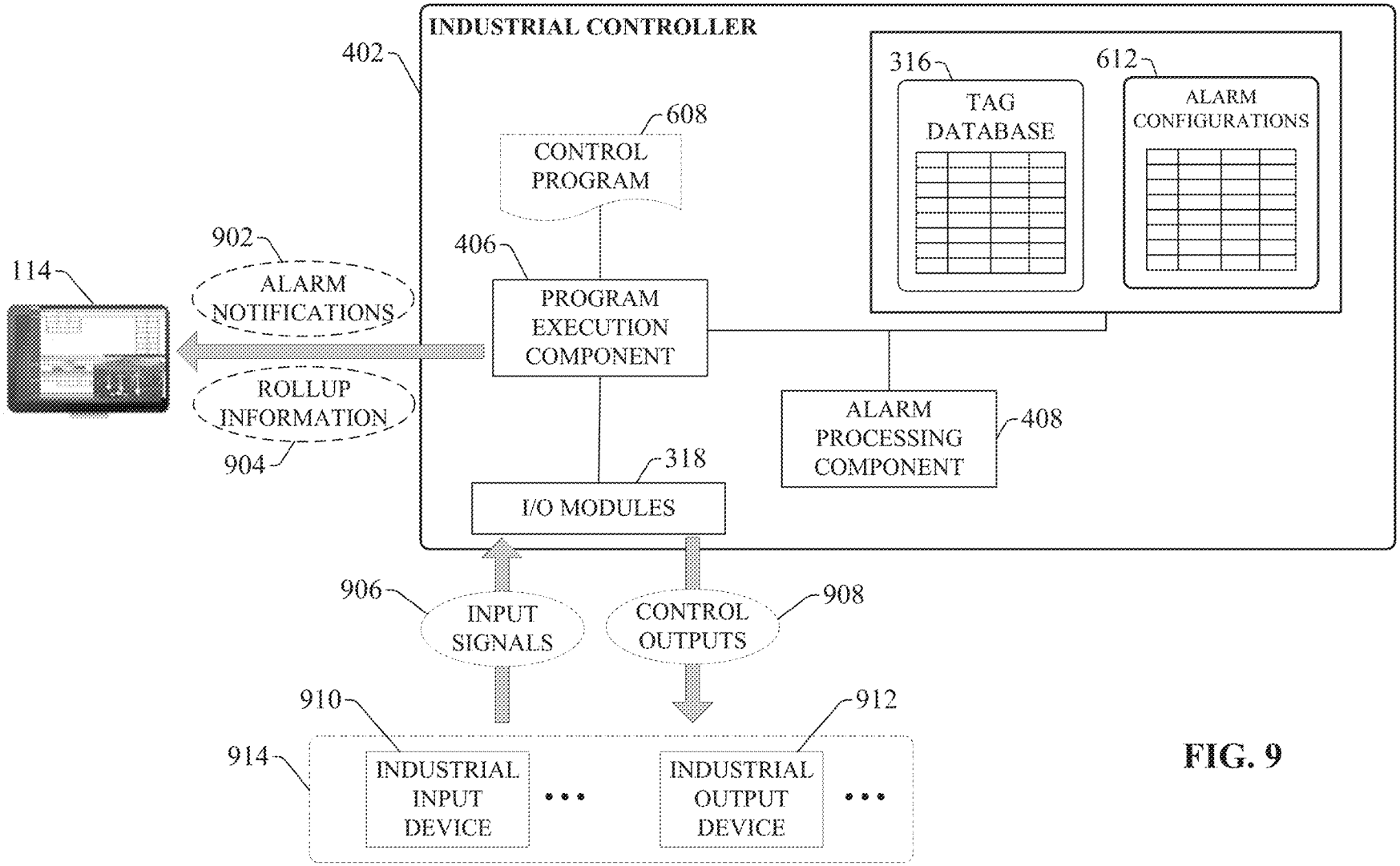
FIG. 9 is a diagram illustrating operation of an industrial control device during runtime after the device has been configured to associate alarm conditions with controller tags.

After development of control program 608 is complete and the tag definitions 610 and alarm configurations 612 have been defined, the controller configuration data 606—including the compiled program 608 and associated alarm condition and alarm set definitions—is downloaded to the control device 402 (see FIG. 6). FIG. 9 is a diagram illustrating operation of industrial control device 402 during runtime after the device 402 has been configured as described above. During runtime, program execution component 406 executes the control program 608 in connection with controlling an industrial system, machine, or process 914. As described above, control output signals 908 generated by the control device's digital and analog outputs and directed to corresponding output devices (e.g., actuators, valves, motor drives, contactors, stack lights, etc.) are controlled in accordance with control program 608 based in part on input signals 906 received from industrial input devices 910 (e.g., push buttons, part presence sensors, proximity switches, temperature measurements, pressure measurements, etc.).

During real-time control, alarm processing component 408 evaluates the alarm conditions and alarm sets defined by alarm configuration data 612, and generates alarm notification data 902 in response to determining that one or more of the defined alarm conditions are satisfied. Alarm processing component 408 makes this alarm notification data 902—as well as the alarm condition and alarm set information—accessible to external applications, similar to other control system information. Thus, the alarm notification data 902 can be read by an HMI 114 communicatively connected to the control device 402 (e.g., via a plant network 116 or via a direct hardwired or wireless connection) and rendered on an appropriate alarm display screen generated by the HMI 114. Although the alarm configuration data 612 is stored on the industrial control device 402, some embodiments of alarm processing component 408 can evaluate and process alarm conditions using separate processing resources from those used to execute control program 608, or using a separate execution thread relative to the control program. In this way, alarm conditions are processed without impacting execution of the control program 608 or introducing latency into the control process.

If alarm sets 802 have been configured as part of alarm configuration data 612, alarm processing component 408 will also generate rollup information for each defined alarm set. This rollup information 904 can also be read by and rendered on HMI 114. Rollup information 904 and other alarm set behaviors are discussed in more detail below.

Using this alarm configuration system, alarm conditions and alarm sets are independently creatable and configurable components that reside within the industrial control device 402 but can be configured separately from the control program 608 and other configurable parameters of the control device 402. For example, if a user wishes to add new alarm conditions, edit an alarm set to add or remove alarm conditions, or reassign alarm conditions or alarm sets to different controller tags, such changes can be implemented by modifying alarm configuration data 612 (e.g., using device configuration application 604) without requiring the control program 608 to be edited, interrupted, or re-downloaded. In this way, alarm conditions can be created, configured, or deleted in the control device 402 (e.g., industrial controller, motor drive, etc.) regardless of the current control system state and are not directly connected to the control program or application code.

When an alarm condition or alarm set is associated with a controller tag, the alarm condition or alarm set becomes accessible as an extended member or property of its associated controller tag (or other type of component with which the alarm conditions or alarm sets are associated, such as a control instruction, a data type, an I/O module, a motion control axis, etc.). Members of the alarm conditions and alarm sets are accessible programmatically as controller tag extensions, and are also accessible externally from an HMI 114 or other client-side applications. Programmatic and external access to alarm condition data members and alarm set data members is similar to access to other tags defined in the control device 402.

Since alarm condition and alarm set properties are made available as extended members of controller tags, these properties can be accessed programmatically, allowing changes to be made to the alarm conditions by the control program 608 itself. In an example scenario, operation of an industrial process may require changes to be made to the configuration of one or more alarm conditions based on the state of the process. This may include, for example, disabling or enabling evaluation of the alarm conditions, changing the value of a high limit alarm defined by the alarm condition, or other such changes. While these changes can be made by an operator, some embodiments of the alarm processing system described herein can allow the control application or control program 608 to implement these changes by accessing the appropriate controller tag's alarm extensions or alarm properties.

For example, control program 608 can include code that, when executed by program execution component 406, suppresses selected alarm conditions to prevent these alarm conditions from generating unnecessary or nuisance alarm notifications while a process or machine is in the process of initializing. Suppressing or disabling an alarm condition in this manner prevents evaluation of the alarm condition by the alarm processing component 408. After the process or machine has achieved steady state operation, the program code can re-enable the alarm conditions to allow normal evaluation of the alarm conditions. In another example, the control program 608 can adjust the limit conditions that trigger a given alarm based on the particular process control recipe that is currently being executed by the control device 402. In general, the alarm configuration architecture described herein can allow the programmer to define conditions of the controlled process or machine under which properties of selected alarm conditions are modified (e.g., whether the alarm is enabled or disabled, high or low limits that trigger the alarm, etc.).

Programmatic alarm configuration changes such as those described above can be supported using several techniques. In the following examples, Tank101 is an instance of an add-on instruction that manages inflow and outflow for a material storage tank. In a first technique for programmatically changing an alarm configuration, a member of an alarm condition or an alarm set can be directly programmatically accessed from code outside of the add-on instruction. For example, such outside code can programmatically access or reference the tag extension Tank101.Level@ alarms.HiLevel.Limit (or other suitable nomenclature) and modify the high level limit for the alarm for Tank101 by altering a value associated with this extension. The alarm configuration architecture can leverage association information at compile time to resolve the reference to the alarm condition for the high level alarm for Tank101. According to this example nomenclature, the extension @alarms.HiLevel.Limit is an extended member of the controller tag representing a property of the alarm condition associated with the Tank101 (the instance of the add-on instruction). Modifying the value associated with this extension modifies the alarm condition such that the new value is used as the high limit value that triggers the alarm.

Figure 10:
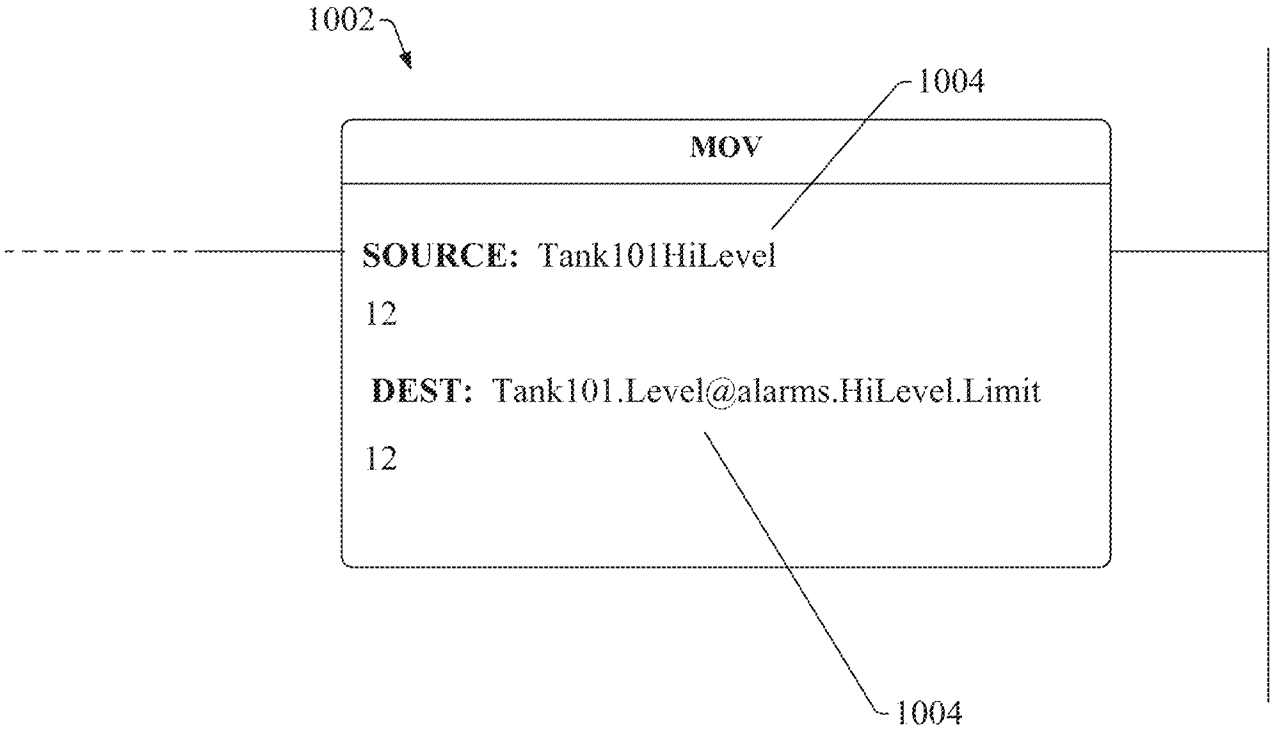
FIG. 10 is an example ladder logic instruction that can be used to modify a high level limit for control devices programmed using ladder logic.

FIG. 10 is an example ladder logic instruction 1002 that can be used to modify this high level limit for control devices 402 that support ladder logic programming In this example, a Move (MOV) instruction is configured to move an integer value stored in a tag named Tank101HiLevel to the alarm reference Tank101.Level@alarms.HiLevel.Limit. Additional code can be written that changes the value stored in tag Tank101HiLevel as needed depending on the state of the controlled process, thereby modifying the high level limit alarm threshold for Tank101.

Other properties of the alarm condition associated with Tank101 can also be accessed programmatically in this manner, including both read-only properties as well as read-write properties. Other properties of the alarm condition that can be accessed, viewed, and/or modified as extensions of the associated controller tag can include, but are not limited to, a state of the alarm condition (e.g., active, inactive, acknowledged, unacknowledged, etc.), a severity level to be assigned to the alarm condition, an ON delay value associated with the alarm condition (defining an amount of time between satisfaction of the alarm condition and generation of the corresponding alarm notification), an OFF delay value associated with the alarm conditions (defining an amount of time between removal of the condition causing the alarm and removal of the alarm notification), an acknowledge command property, a disable or enable property, a suppress or unsuppressed property, or other such alarm condition properties.

In a second technique for programmatically changing an alarm configuration, a member of the alarm condition or the alarm set for an instance of the Tank101 add-on instruction can be accessed from within the add-on instruction application. For example, a high level alarm conditions created for a present instance of the tank can be accessed by referencing This.Level@alarms.HiLevel.Limit. The system can determine the correct alarm condition to reference for the instance of the add-on instruction that is being executed at runtime. The alarm system can use information within the alarm set object to resolve the reference to the high level alarm condition limit value. Additional alarms can be added to the definition without compromising access to the alarm conditions that were previously referenced.

These alarm-specific tag extensions can also be accessed by external applications, such as HMIs 114, in order to view and/or modify properties of selected alarm conditions or alarm sets. For example, the HMI can be configured to render interactive graphical objects—such as text boxes, graphical push buttons, or the like—that are linked to the controller tag's alarm extensions. As such, an operator can modify or view an alarm condition property via these interactive graphical objects.

The configurable properties of an alarm condition or alarm set can include a property that defines whether the alarm condition is to be enabled or disabled. This property can be set during initial configuration of the alarm condition (e.g., using device configuration application 604), but can also be modified during runtime, either programmatically or in response to a command received from an external application (e.g., an HMI 114). Enabling an alarm condition instructs the alarm processing component 408 to evaluate the alarm condition in the normal manner, and to generate an alarm notification in response to determining that the alarm condition has been satisfied. Disabling the alarm condition prevents evaluation of the alarm condition by the alarm processing component 408, such that no alarm notifications 902 will be generated for the alarm condition even if the condition is satisfied. The enabled/disabled property of an alarm condition can be set programmatically using a suitable control instruction within control program 608 that accesses the appropriate alarm condition setting (e.g., by writing to tag property Tank101.Level@alarms.HiLevel.enable). In an example scenario, the control program 608 may be written to set the alarm condition to be disabled during a transitional start-up period of a machine controlled by control device 402 (in order to prevent nuisance alarm notifications), and to be re-enabled after the machine reaches steady state operation.

Similar techniques for programmatically changing an alarm configuration can also be applied to alarm sets. Moreover, these programmatic operations can be applied to multiple levels of nested add-on instructions, and can also be generalized to support similar access from programs.

Figure 11:
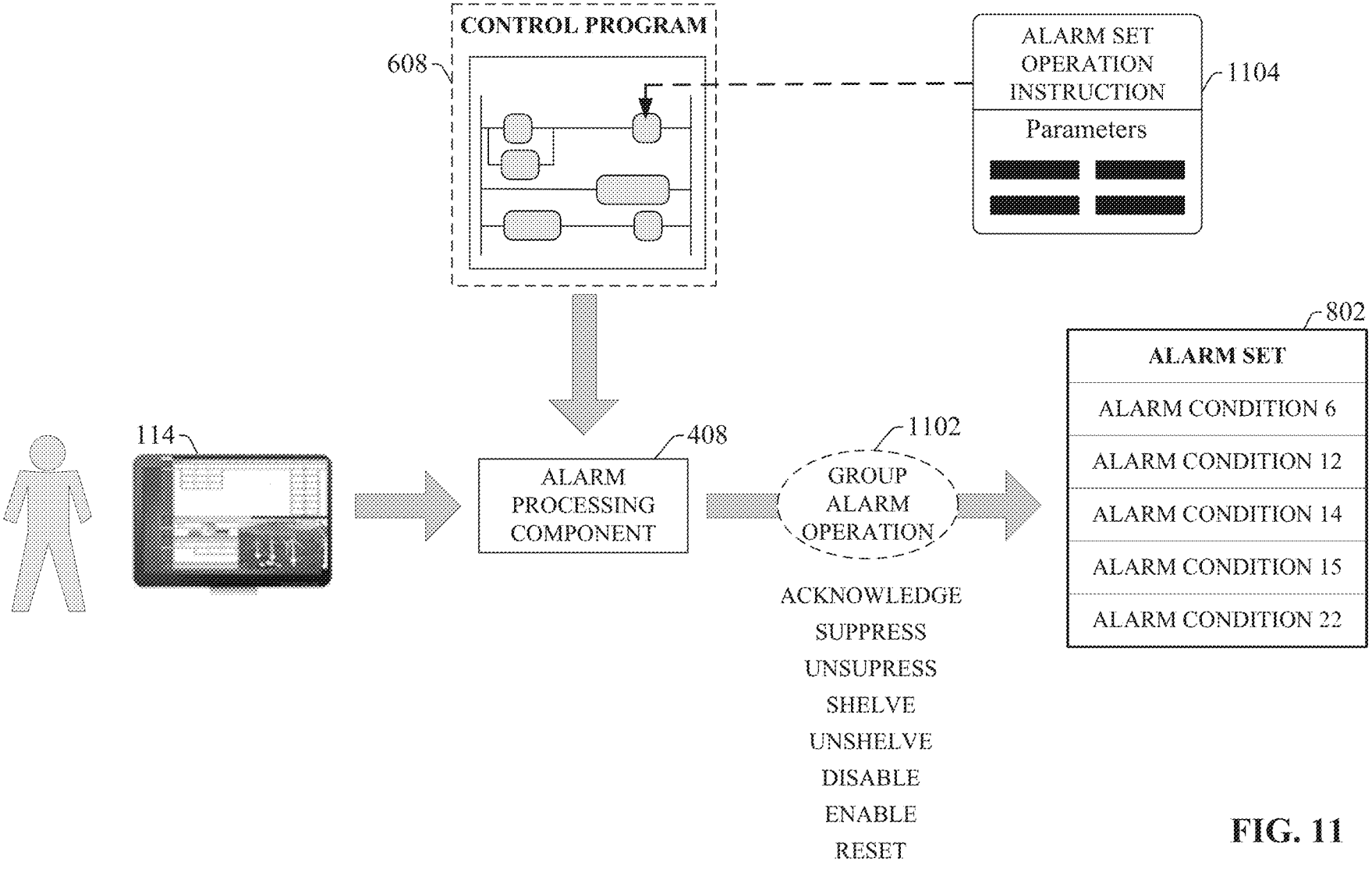
FIG. 11 is a diagram illustrating application of a group alarm operation to an example alarm set.

As noted above, embodiments of the industrial alarm system described herein allows sets of related alarm conditions to be grouped as alarm sets 802. Once these alarm sets 802 are defined, alarm processing component 408 allows interactive operations to be applied collectively to the related alarm conditions defined within the alarm set 802. FIG. 11 is a diagram illustrating application of a group alarm operation 1102 to an example alarm set 802. By grouping a set of alarm conditions into an alarm set 802, alarm operations 1102 can be performed on the alarm set 802 by an operator (e.g., via HMI 114) or programmatically using an alarm set operation instruction 1104 executed within control program 608. Example group alarm operations 1102 that can be applied to the alarm set 802 can include, but are not limited to, alarm acknowledge commands, commands to suppress or unsuppress the alarm conditions in the alarm set 802, commands to shelve or unshelve the alarm conditions, commands to disable or enable the alarm conditions, reset commands applied to the alarm conditions, or other such alarm operations.

In an example scenario, an HMI 114 can include an interactive control graphic (e.g., a graphical pushbutton or other type of control) that sends a message to the control device 402 to initiate the selected group alarm operation 1102 on a selected alarm set 802. The message may be, for example, a request to acknowledge the active alarm conditions in the alarm set 802. Since the group alarm operation 1102 is directed to the alarm set 802 rather than a single alarm condition, alarm processing component 408 applies the operation 1102 to all alarm conditions within the alarm set 802.

Group alarm operation 1102 directed to selected alarm sets 802 can also originate from the control program 608 itself. In an example embodiment, an alarm set operation instruction 1104 can be included in the control program 608. Parameters of the alarm set operation instruction 1104 can include an identity of the alarm set 802 to which the operation is to be directed as well as the type of group alarm operation to be applied to the selected alarm set 802 (e.g., acknowledge, suppress, disable, etc.). When the instruction 1104 is executed by control program 608 in response to conditions defined by the programmer, the indicated group alarm operation 1102 is iterated over all alarm conditions defined in the alarm set 802. The alarm system allows alarm conditions to be added to or removed from the alarm set 802 (e.g., using device configuration application 604, as described above) without compromising the ability to perform group operations on the alarm conditions associated with the alarm set 802. That is, if a new alarm condition is added to the alarm set 802, subsequent group alarm operations 1102 applied to the alarm set 802 will be applied to the newly added alarm condition as well as the previously included alarm conditions.

By allowing grouped alarm conditions to be acted on collectively as an alarm set 802, alarm operations 1102—such as acknowledgements, alarm suppress operations, alarm disablement, etc.—can be performed on all alarm conditions within the alarm set 802 in response to a single input operation (e.g., a single HMI pushbutton interaction or a single execution of an alarm set operation instruction 608). This single input operation can access the alarm set 802 using a single programmatic reference directed to the alarm set 802, such that the programmatic reference causes the group alarm operation 1102 to be applied to all alarm conditions associated with the referenced alarm set 802.

Figure 12:
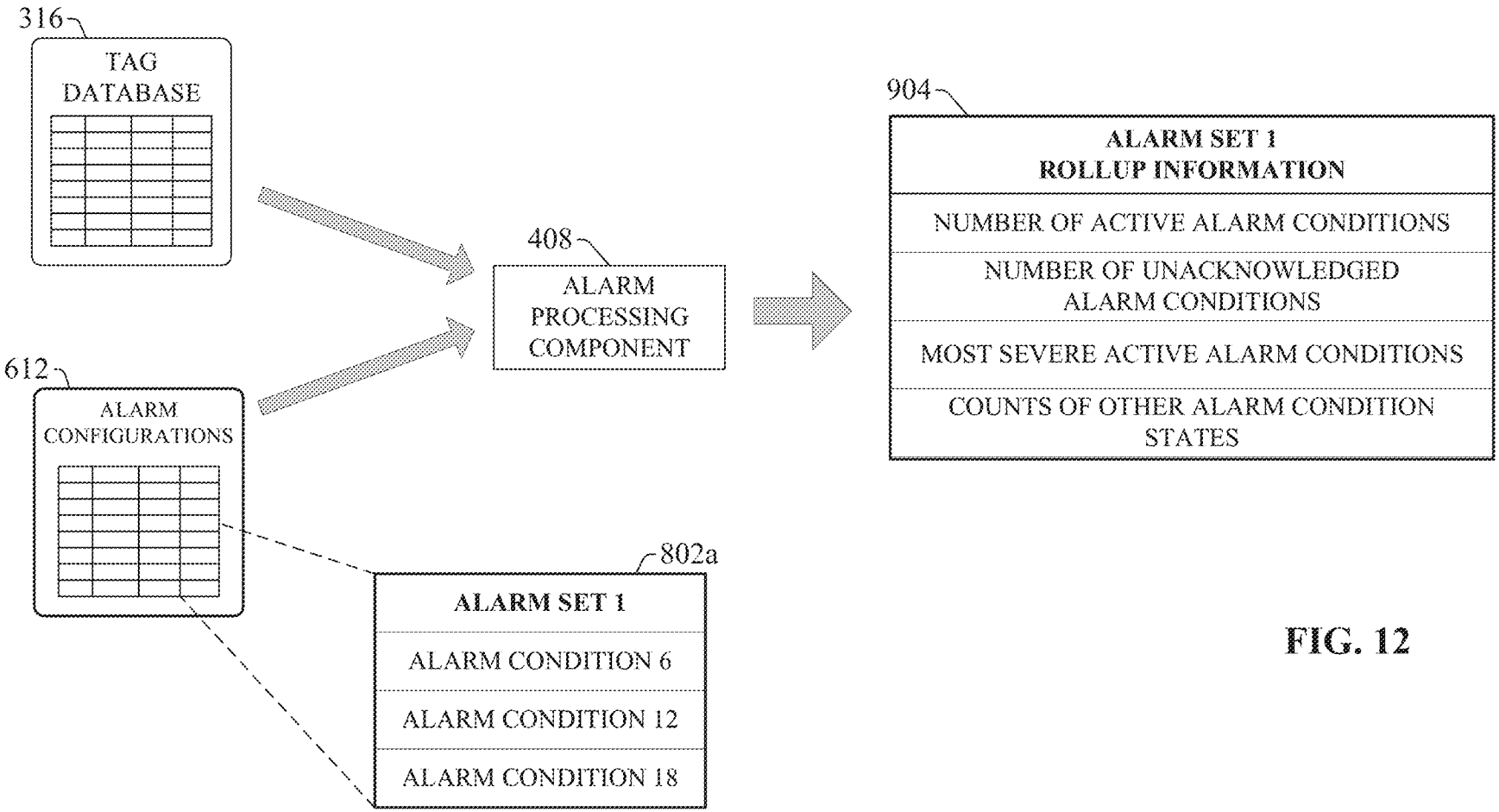
FIG. 12 a diagram illustrating generation of rollup information for an alarm set.

Alarm processing component 408 can also generate rollup information 904 for each defined alarm set 802. FIG. 12 is a diagram illustrating generation of rollup information 904 for an alarm set (Alarm Set 1). Rollup information 904 conveys collective or aggregated alarm state or statistical information for the alarm conditions associated with the alarm set 802. Example rollup information 904 for an alarm set 802 can include, but is not limited to, a total number of active alarm conditions within the alarm set 802, a total number of unacknowledged alarm conditions within the alarm set 802, an indication of the most severe or urgent alarm condition of all currently active alarm conditions within the alarm set 802, total counts of other current alarm condition states, or other such information. During runtime, alarm processing component 408 can generate this rollup information 904 for each defined alarm set 802. In general, alarm processing component 408 calculates the alarm statistics to be included in rollup information 904 based on the identities of the alarm conditions within the alarm set 802, the current states of the controller tags associated with each alarm condition within the alarm set 802 (as read from the tag database 316), and values of each alarm condition's properties (e.g., acknowledged or unacknowledged, enabled or disabled, etc.). Alarm processing component 408 uses this information to determine the states of each alarm condition, and aggregates this state information for all alarm conditions within the alarm set 802 to yield rollup information 904.

Rollup information 904 is accessible from external applications, such as HMIs 114. This allows rollup information 904 to be read by an HMI 114 and rendered on a suitable display screen. Since an alarm set 802 will typically comprise alarm conditions that relate to a common area of concern (e.g., a common production area or machine, a common industrial process, etc.), this rollup information 904 can convey useful summary information for a given aspect of a controlled industrial machine or process.

Rollup information 904 can also be accessed programmatically by user application code, including control program 608 as well as application code that is external to control device 402. During runtime, rollup information 904 can be monitored by applications executing on HMI 114 or other client devices communicatively connected to the control device 402.

Figure 13A:
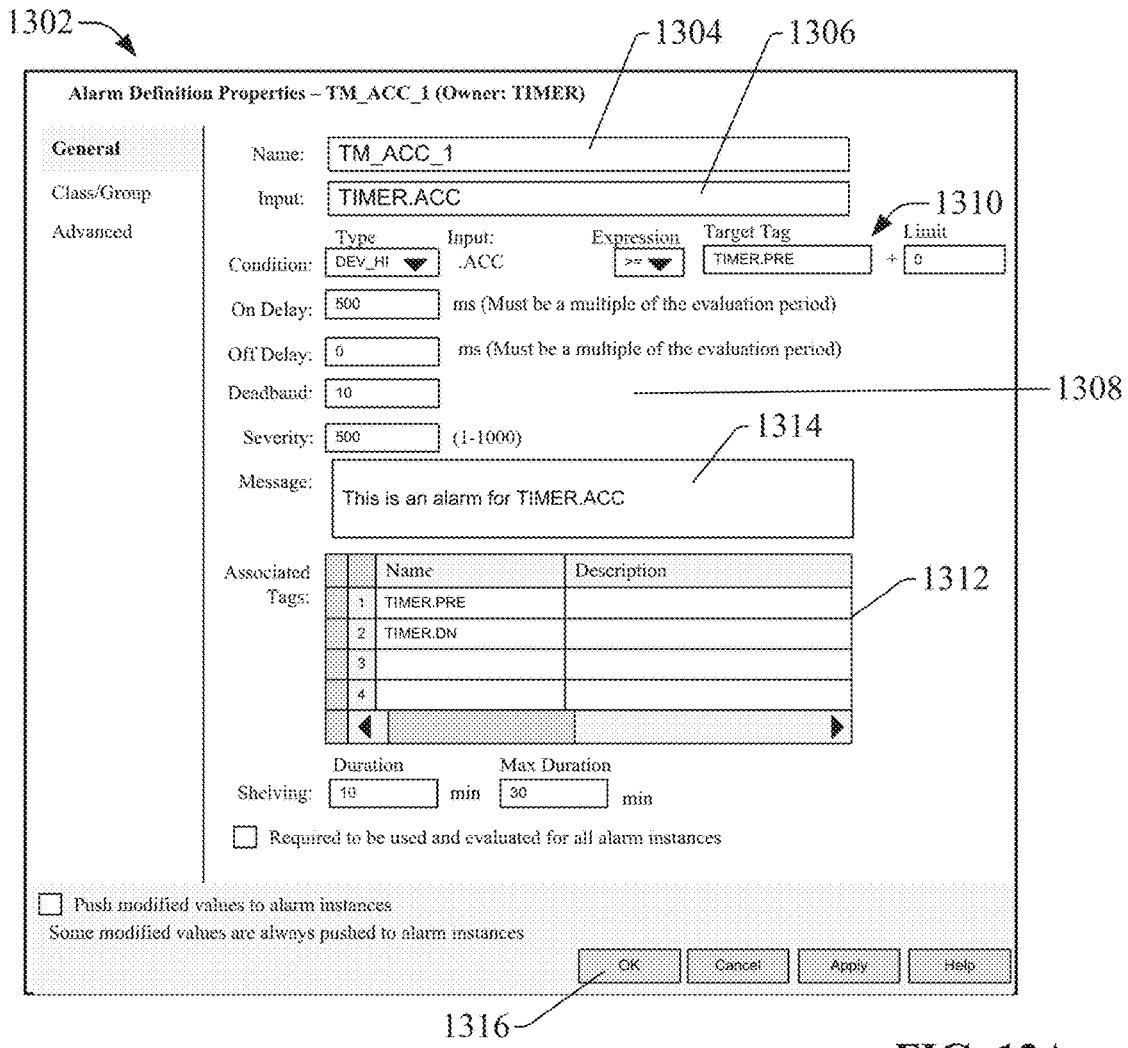
FIG. 13A is an example alarm configuration display that can be generated by a program development component and used to define an alarm configuration.
Figure 13B:
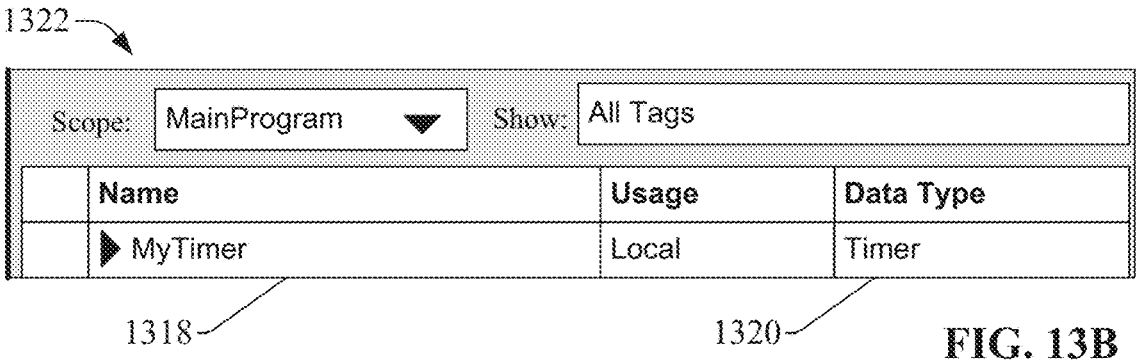
FIG. 13B is a screen shot of a portion of an example tag definition display that can be generated by a program development component and used to create tags in connection with development of a control program.
Figure 13C:
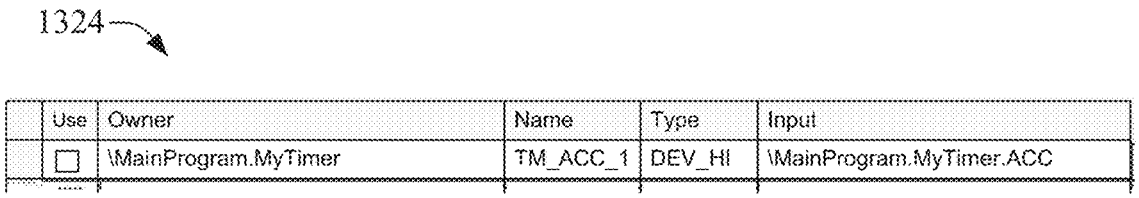
FIG. 13C is a screen shot of a portion of an example alarm association display that can be generated by a program development component.

In various embodiments, alarm configuration component 506 of control program development system can support at least two workflows for applying an alarm condition to a controller tag, which depend on the order in which a tag and an alarm condition is created during development of the control program project (represented by controller configuration data 606). FIGS. 13A-13C are screen shots of example configuration displays (e.g., displays of device configuration application 604) that can be generated by alarm configuration component 506 and used to associate alarm conditions with one or more controller tags. Alarm conditions that are defined in this manner can be reused as needed to associate the defined alarm conditions to multiple controller tags. In the example illustrated in FIGS. 13A-13C, the alarm condition is created first, and is then applied to a controller tag. Alarm configuration display 1302 depicted in FIG. 13A (or a similar display) can be invoked by a user within the development environment rendered by the control program development system 502. Configuration display 1302 can include a Name field 1304 for defining a name of the reusable alarm condition being defined (TM_ACC_1 in the illustrated example), and an Input field 1306 for defining a data type member (TIMER.ACC in the illustrated example) with which the alarm condition will be associated. The data type member is a property of a particular tag data type. For example, TIMER.ACC is a timer accumulator property that is included in all instances of a TIMER data type (that is, a property that is associated with a data tag having the TIMER data type). Accordingly, in the present example, when a controller tag is subsequently created with the TIMER data type, the alarm configurations defined in alarm configuration display 1302 and associated with the TIMER.ACC data type member will be applied to the new TIMER data tag.

A configuration area 1308 includes other fields for entering additional configuration information for the alarm condition. For example, configuration area 1308 can include a set of condition fields that allow a user to define a condition that will trigger the alarm in terms of an alarm type (e.g., high alarm, low alarm, etc.), a controller tag against which the alarm will be evaluated, and an expression that defines the trigger condition for the alarm relative to the target tag. In the illustrated example, the TIMER.PRE (timer preset) tag property is set as the target tag, such that the alarm will be triggered when the timer accumulator value (TIMER_ACC) is greater than or equal to the timer preset value associated with the data tag. This condition is only intended to be exemplary, and it is to be appreciated that other conditions for triggering the alarm can be defined using alarm configuration display 1302.

Associated tags area 1312 lists a set of other tags that are captured synchronously when the alarm is activated. The values of these associated tags are sent as part of the alarm notification data 902 for the alarm conditions when the alarm condition is triggered. In the illustrated example, these associated tags include a Timer Preset value (TIMER.PRE) and a Timer Done property (TIMER.DN).

Configuration area 1308 can also include fields for entering delay settings (e.g., an ON delay and an OFF delay) defining a duration of time that the alarm condition must be satisfied before the alarm notification is triggered (the ON delay) and a duration of time that the alarm condition must be false before an active alarm notification will be cleared (the OFF delay). In some embodiments, configuration area 1308 can also include fields that allow the user to define a deadband for the alarm condition and a severity level, where the severity level may determine a manner in which the alarm condition is presented to a user via the HMI 114 (e.g., a frequency of reminders, a color code for the alarm message, etc.). A message field 1314 can allow the user to enter an alarm message to be rendered as part of the alarm notification data 902 when the alarm is active. The alarm configuration information can be saved as a reusable alarm configuration by selecting the OK button 1316.

After the alarm condition has been defined (named TM_ACC_1 in the present example), the alarm configuration component 506 will automatically apply the defined alarm condition to subsequently created data tags having the TIMER data type. FIG. 13B is a screen shot of a portion of an example tag definition display 1322 that can be generated by program development component 504 and used to create tags in connection with development of a control program. A Name field 1318 allows the user to enter a name for the new tag (MyTimer in the illustrated example), and a Data Type field 1320 allows the user to select the data type for the new tag. Since the user has selected the TIMER data type for the new tag, the new tag will have a TIMER.ACC property, and consequently the alarm configuration component 506 will apply the previously defined alarm condition associated with the TIMER.ACC member to the new tag. FIG. 13C is a screen shot of a portion of an example alarm association display 1324 showing that the new tag (MainProgram.MyTimer) is associated with the alarm definition named TM_ACC_1.

The previous example described a workflow for associating an alarm condition with a controller tag in which the alarm condition was defined first, and was then automatically applied to a new controller tag created subsequently. However, alarm conditions can also be defined and applied to controller tags created prior to definition of the alarm condition. For example, a new tag—MyTimer—may be created first using tag definition display 1322, as shown in FIG. 13B. As in the previous example, the new tag is defined to have a TIMER data type. After creation of this tag, an alarm condition is defined using alarm configuration display 1302, as shown in FIG. 13A. Once the alarm condition is saved, alarm configuration component 506 automatically applies the new alarm condition to all relevant, previously created controller tags (that is, previously created tags having the TIMER data type), including MyTimer, as shown in FIG. 13C.

Although the previous examples applied reusable alarm conditions to tags having the TIMER data type, it is to be appreciated that similar techniques can be used to automatically apply user-defined alarm conditions to any other tag data type (e.g., COUNTER, user-defined data types, nested user-defined data types, etc.), as well as to control program function block types (e.g., PID function blocks), add-on instruction types, nested add-on instruction types, etc.

Alarm configuration component 506 also allows the user to modify an alarm condition after the alarm condition has been associated with one or more controller tags. When modifications are made to an existing alarm condition, the alarm modifications will be automatically applied to the controller tags with which the alarm condition was previously associated.

The industrial alarm configuration system described herein allows alarm conditions and alarm sets to be defined and evaluated within an industrial control device independently of the control program executing on the control device. These alarm conditions can be created, assigned to selected control tags, and modified as needed without the need to edit the control program. Once created, the alarm conditions and alarm sets can be assigned as needed to selected controller tags, AOIs, I/O modules, or other control objects, eliminating the need to individually re-enter the same alarm configuration information multiple times for multiple control objects. By allowing these alarm conditions to be grouped into alarm sets, operations or commands can be applied to multiple related alarm conditions using a single user-initiated or program-initiated action. These alarm sets also provide aggregated alarm summary information for the alarm conditions defined within each alarm set.

FIGS. 14-17 illustrate various methodologies in accordance with one or more embodiments of the subject application. While, for purposes of simplicity of explanation, the methodologies shown herein are shown and described as a series of acts, it is to be understood and appreciated that the subject innovation is not limited by the order of acts, as some acts may, in accordance therewith, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation. Furthermore, interaction diagram(s) may represent methodologies, or methods, in accordance with the subject disclosure when disparate entities enact disparate portions of the methodologies. Further yet, two or more of the disclosed example methods can be implemented in combination with each other, to accomplish one or more features or advantages described herein.

Figure 14:
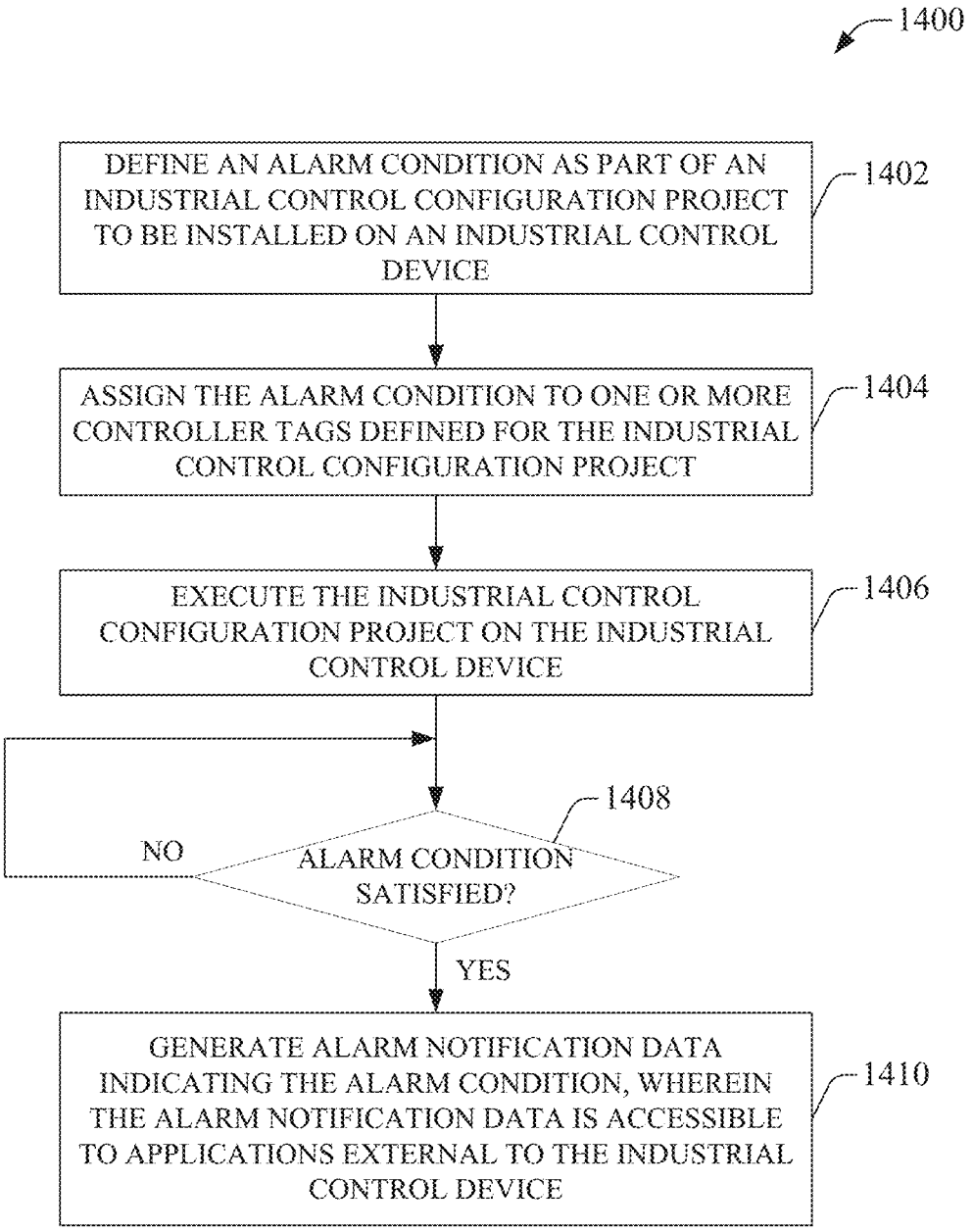
FIG. 14 is a flowchart of an example methodology for configuring and processing alarm conditions within an industrial control project.

FIG. 14 is an example methodology 1400 for configuring and processing alarm conditions within an industrial control project. Initially, at 1402, an alarm condition is defined as part of an industrial control configuration project to be installed on an industrial control device, such as an industrial controller (e.g., a PLC) or another type of industrial control device. The alarm condition can specify conditions under which an alarm notification will be generated (e.g., a metric deviating from a high or low limit, a machine or process state, etc.). The alarm condition can be defined within a development environment of a device configuration application that executes on a client device.

At 1404, the alarm condition defined at step 1402 is assigned to one or more controller tags defined for the industrial control configuration project. This can be achieved by assigning the alarm condition to an explicitly selected controller tag defined for the control project. Alternatively, the alarm condition can be assigned to system-defined or user-defined data type, which causes the alarm condition to be applied to any defined controller tags that are instances of the data type. Assigning the alarm condition to a controller tag causes the alarm condition to be a function of the state or value of that controller tag. For example, if the alarm condition specifies that an alarm notification is to be generated in response to a measured value exceeding a defined high limit value, assigning the alarm condition to a specified controller tag causes the value of the controller tag to be used as the measured value that determines whether the alarm condition is satisfied, such that the alarm notification will be generated when the value of the assigned controller tag exceeds the high limit defined by the alarm condition.

At 1406, the industrial control configuration project, including the alarm configuration and assignment information entered at step 1402 and 1404, are executed on the industrial control device. During execution, the alarm condition is evaluated relative to the value or state of its assigned controller tag to determine whether the defined alarm condition is satisfied. At 1408, a determination is made as to whether the alarm condition is satisfied. If the alarm condition is satisfied (YES at step 1408), the methodology proceeds to step 1410, where alarm notification data is generated indicating the alarm condition. This alarm notification data is accessible to applications external to the industrial control device (e.g., HMI devices or other types of client devices).

Figure 15:
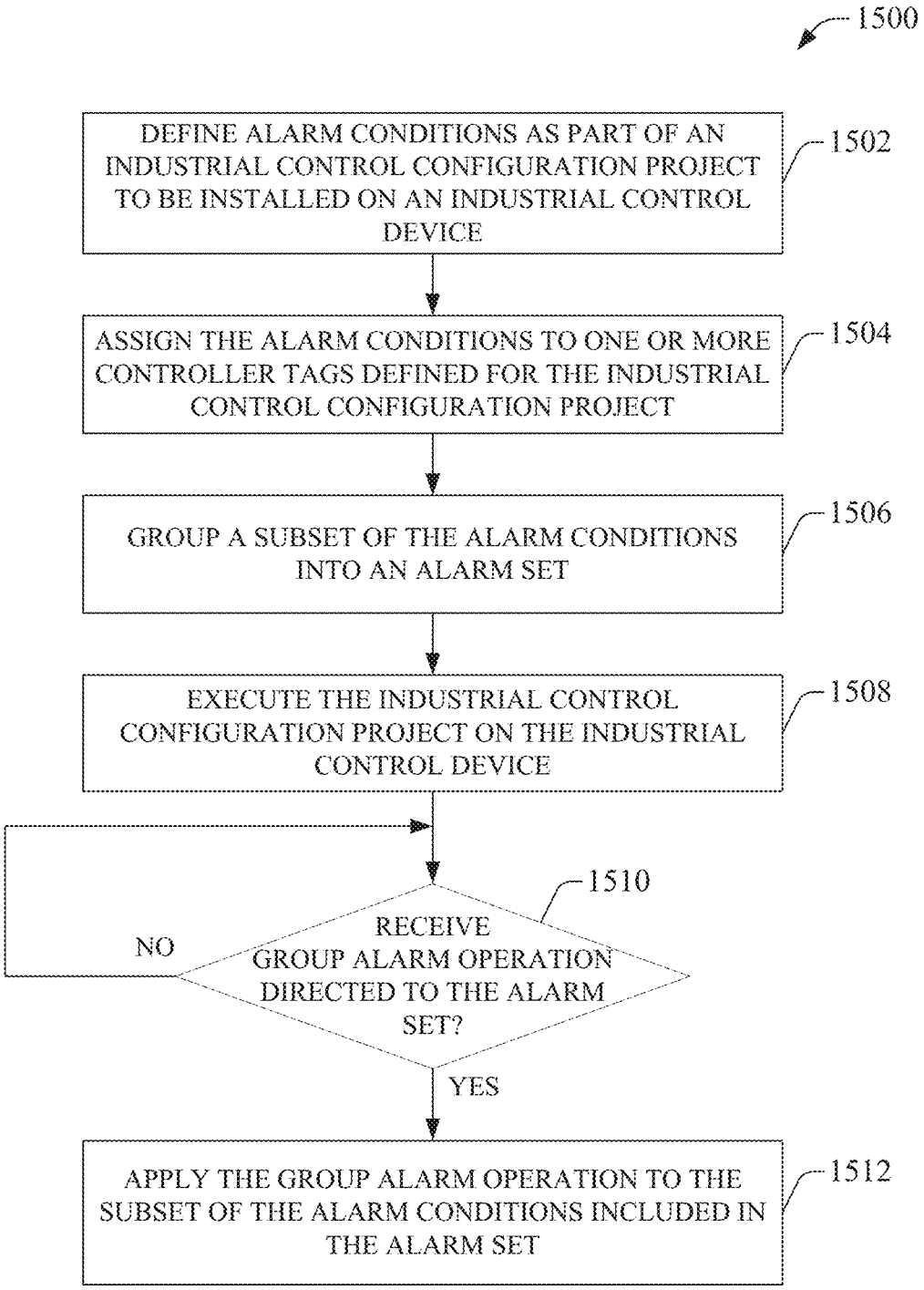
FIG. 15 is a flowchart of an example methodology for configuring and processing alarm sets within an industrial control project.

FIG. 15 is an example methodology 1500 for configuring and processing alarm sets within an industrial control project. Initially, at 1502, alarm conditions are defined as part of an industrial control configuration project to be installed on an industrial control device (similar to step 1402 of methodology 1400). At 1504, the alarm conditions are respectively assigned to one or more controller tags defined for the industrial control configuration project (similar to step 1404 of methodology 1400). Each alarm condition may be assigned to multiple controller tags.

At 1506, a subset of the alarm conditions defined at step 1502 are grouped into an alarm set. The alarm set may include multiple alarm conditions that are deemed by the project developer to be related for the purposes of collective group alarm operations or commands.

At 1508, the industrial control configuration project—including the alarm condition and alarm set definitions—are executed on the industrial control device. At 1510, a determination is made as to whether a group alarm operation directed to the alarm set has been received. The group alarm operation may originate from a control program that executes on the industrial control device, or from an application that is external to the control device, such as an HMI terminal. The group alarm operation may be, for example, an alarm acknowledge command, a command to suppress or unsuppress the alarm conditions within the alarm set, a command to shelf or unshelve the alarm conditions, a command to disable or enable the alarm conditions, a reset command to be applied to the alarm conditions, or other such alarm operations.

If the group alarm operation is received (YES at step 1510), the methodology proceeds to step 1512, where the group alarm operation received at step 1510 is applied to all alarm conditions of the subset of alarm conditions included in the alarm set.

Figure 16:
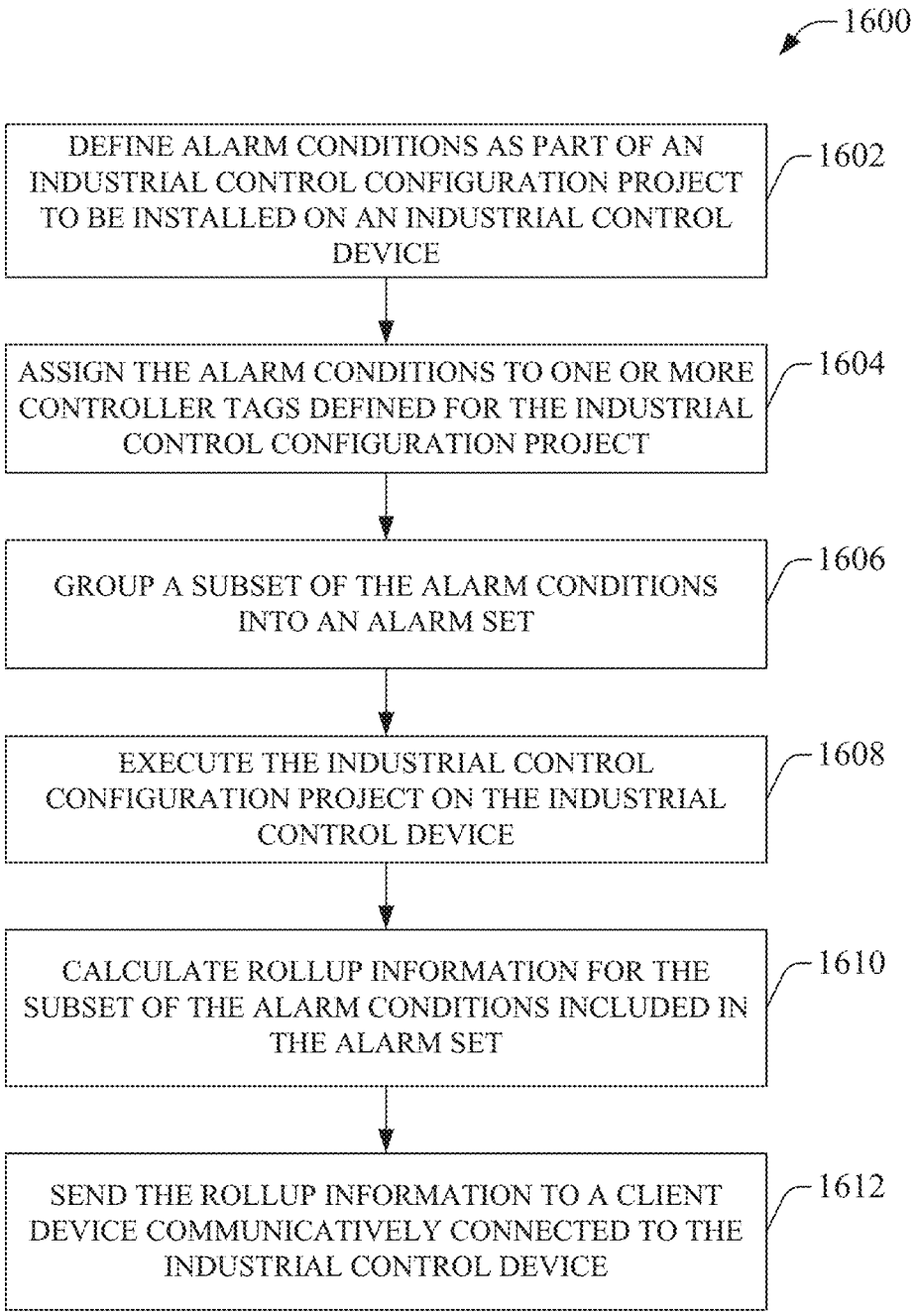
FIG. 16 is a flowchart of an example methodology for configuring and processing alarm sets to generate alarm rollup information for a selected group of alarm conditions.

FIG. 16 is an example methodology 1500 for configuring and processing alarm sets to generate alarm rollup information for a selected group of alarm conditions. Initially, at 1602, alarm conditions are defined as part of an industrial control configuration project to be installed on an industrial control device (similar to step 1502 of methodology 1500). At 1604, the alarm conditions are respectively assigned to one or more controller tags defined for the industrial control configuration project (similar to step 1504 of methodology 1500). At 1606, a subset of the alarm conditions defined at step 1602 are grouped into an alarm set (similar to step 1506 of methodology 1500). At 1608, the industrial control configuration project is executed on the industrial control device (similar to step 1508 of methodology 1500).

At 1610, rollup information for the subset of the alarm conditions included in the alarm set defined at step 1606 is calculated. This rollup information can include, but is not limited to, a total number of the alarm conditions in the alarm set that are active, a total number of active alarm conditions of the alarm set that are unacknowledged by an operator, an indication of the most severe or urgent alarm condition of all currently active alarm conditions within the alarm set, total counts of other current states of the alarm conditions included in the alarm set, or other such information. This rollup information can be determined by the industrial control device based on the alarm set definition specified at step 1606. At 1612, the rollup information generated at step 1610 is sent to a client device that is communicatively connected to the industrial control device.

Figure 17:
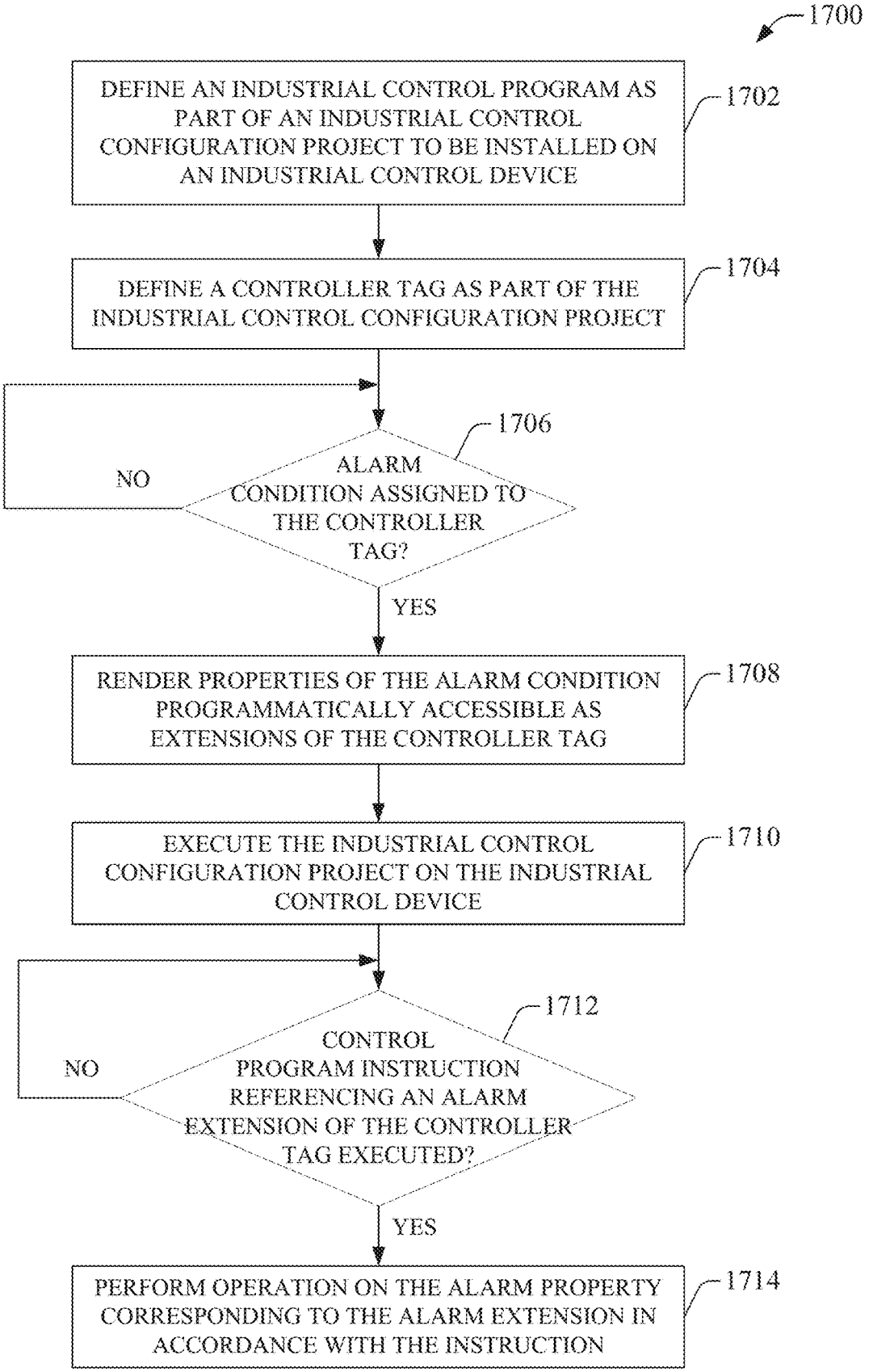
FIG. 17 is a flowchart of an example methodology for configuring alarm condition properties as extensions of controller tags that can be programmatically accessed by control program instructions.

FIG. 17 is an example methodology 1700 for configuring alarm condition properties as extensions of controller tags that can be programmatically accessed by control program instructions. Initially, at 1702, an industrial control program is defined as part of an industrial control configuration project to be installed on an industrial control device (e.g., a PLC or other type of industrial controller). The control program may be, for example, a ladder logic program, one or more sequential function charts, one or more function block diagrams, structured text, or other such program types.

At 1704, a controller tag is defined as part of the industrial control configuration project. The controller tag may be one of multiple controller tags to be included in a controller tag database, and which store digital or analog values generated and referenced by the control program or by the control device's I/O during runtime.

At 1706, a determination is made as to whether an alarm condition has been assigned to the controller tag defined at step 1704. The alarm condition is defined as part of the control configuration project, and defines a condition that is to trigger generation of an alarm notification. Assigning the alarm condition to the controller tag makes the alarm condition a function of the value of the controller tag.

If the alarm condition has been assigned to the controller tag (YES at step 1706), the methodology proceeds to step 1708, where properties of the alarm condition are rendered programmatically accessible as extensions of the controller tag. The properties of the alarm condition that can be accessed programmatically as a result of assigning the alarm condition to the controller tag can include, for example, a high limit or low limit setpoint that will trigger the alarm notification, a state of the controller tag that will trigger the alarm notification, a severity level to be assigned to the alarm condition, an ON delay or OFF delay value associated with the alarm condition, an alarm enable setting, an alarm disable setting, an alarm acknowledgement, or other such properties.

At 1710, the industrial control configuration project is executed on the industrial control device. At 1712, a determination is made as to whether a control program instruction included in the control program is executed that references an alarm extension of the controller tag. If a control program instruction that references the alarm extension of the controller tag is executed (YES at step 1712), the methodology proceeds to step 1714, where an operation is performed on the alarm property corresponding to the alarm extension in accordance with the control program instruction. For example, the control program instruction may change a high alarm limit property of the alarm instruction by writing the desired high limit value to a High Limit property extension of the control tag. Other properties of the alarm condition can also be modified in this manner.

Embodiments, systems, and components described herein, as well as industrial control systems and industrial automation environments in which various aspects set forth in the subject specification can be carried out, can include computer or network components such as servers, clients, programmable logic controllers (PLCs), automation controllers, communications modules, mobile computers, wireless components, control components and so forth which are capable of interacting across a network. Computers and servers include one or more processors—electronic integrated circuits that perform logic operations employing electric signals—configured to execute instructions stored in media such as random access memory (RAM), read only memory (ROM), a hard drives, as well as removable memory devices, which can include memory sticks, memory cards, flash drives, external hard drives, and so on.

Similarly, the term PLC or automation controller as used herein can include functionality that can be shared across multiple components, systems, and/or networks. As an example, one or more PLCs or automation controllers can communicate and cooperate with various network devices across the network. This can include substantially any type of control, communications module, computer, Input/Output (I/O) device, sensor, actuator, instrumentation, and human machine interface (HMI) that communicate via the network, which includes control, automation, and/or public networks. The PLC or automation controller can also communicate to and control various other devices such as standard or safety-rated I/O modules including analog, digital, programmed/intelligent I/O modules, other programmable controllers, communications modules, sensors, actuators, output devices, and the like.

The network can include public networks such as the internet, intranets, and automation networks such as control and information protocol (CIP) networks including DeviceNet, ControlNet, and Ethernet/IP. Other networks include Ethernet, DH/DH+, Remote I/O, Fieldbus, Modbus, Profibus, CAN, wireless networks, serial protocols, near field communication (NFC), Bluetooth, and so forth. In addition, the network devices can include various possibilities (hardware and/or software components). These include components such as switches with virtual local area network (VLAN) capability, LANs, WANs, proxies, gateways, routers, firewalls, virtual private network (VPN) devices, servers, clients, computers, configuration tools, monitoring tools, and/or other devices.

Figure 18:
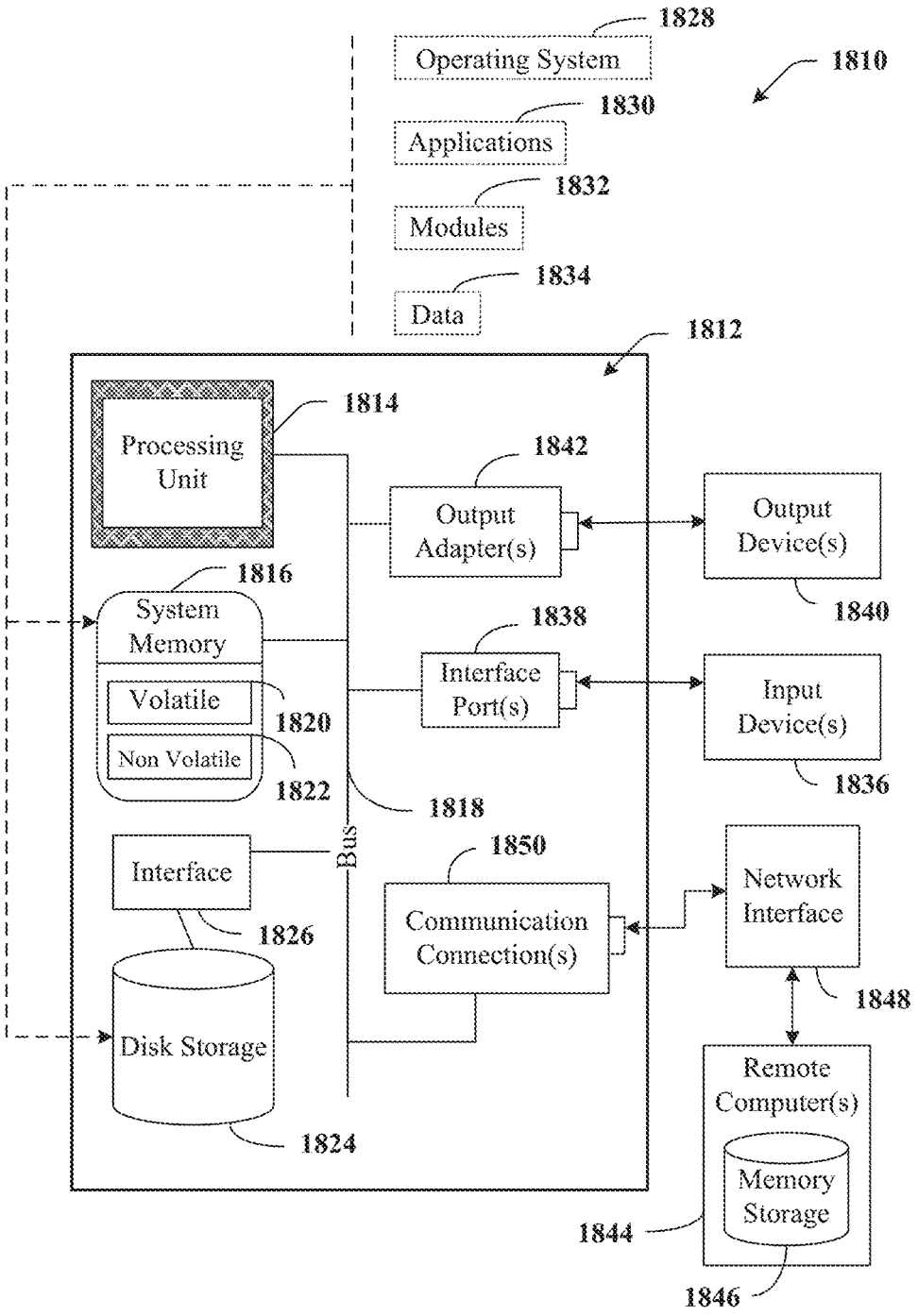
FIG. 18 is an example computing environment.
Figure 19:
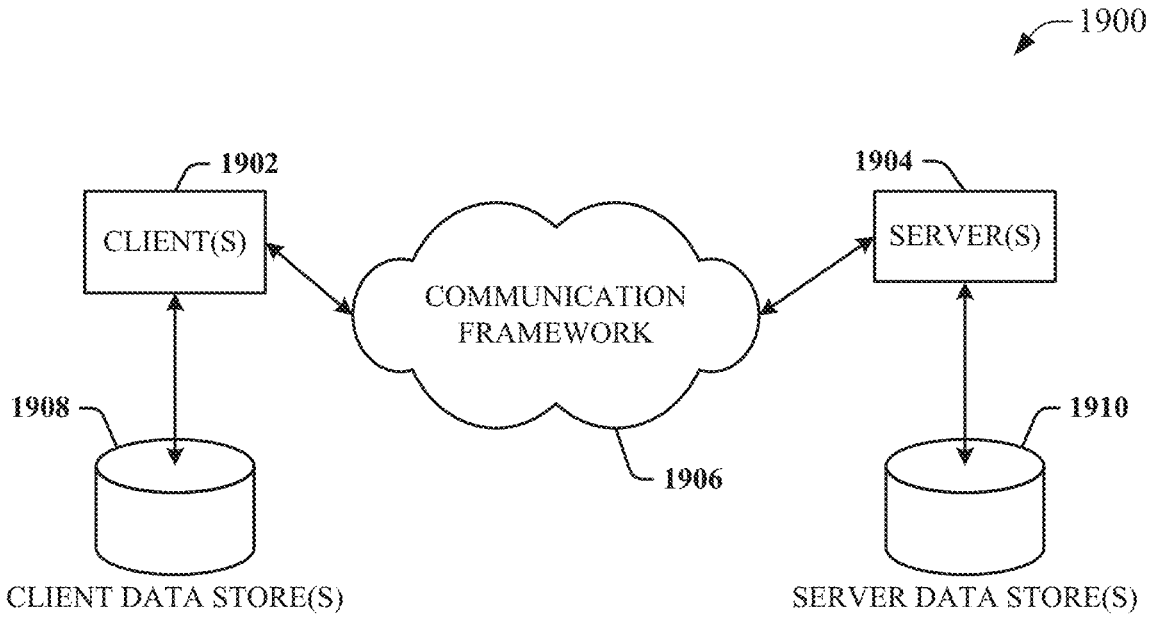
FIG. 19 is an example networking environment.

In order to provide a context for the various aspects of the disclosed subject matter, FIGS. 18 and 19 as well as the following discussion are intended to provide a brief, general description of a suitable environment in which the various aspects of the disclosed subject matter may be implemented.

With reference to FIG. 18, an example environment 1810 for implementing various aspects of the aforementioned subject matter includes a computer 1812. The computer 1812 includes a processing unit 1814, a system memory 1816, and a system bus 1818. The system bus 1818 couples system components including, but not limited to, the system memory 1816 to the processing unit 1814. The processing unit 1814 can be any of various available processors. Multicore microprocessors and other multiprocessor architectures also can be employed as the processing unit 1814.

The system bus 1818 can be any of several types of bus structure(s) including the memory bus or memory controller, a peripheral bus or external bus, and/or a local bus using any variety of available bus architectures including, but not limited to, 8-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 1816 includes volatile memory 1820 and nonvolatile memory 1822. The basic input/output system (BIOS), containing the basic routines to transfer information between elements within the computer 1812, such as during start-up, is stored in nonvolatile memory 1822. By way of illustration, and not limitation, nonvolatile memory 1822 can include read only memory (ROM), programmable ROM (PROM), electrically programmable ROM (EPROM), electrically erasable PROM (EEPROM), or flash memory. Volatile memory 1820 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 1812 also includes removable/non-removable, volatile/nonvolatile computer storage media. FIG. 18 illustrates, for example a disk storage 1824. Disk storage 1824 includes, but is not limited to, devices like a magnetic disk drive, floppy disk drive, tape drive, Jaz drive, Zip drive, LS-100 drive, flash memory card, or memory stick. In addition, disk storage 1824 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 1824 to the system bus 1818, a removable or non-removable interface is typically used such as interface 1826.

It is to be appreciated that FIG. 18 describes software that acts as an intermediary between users and the basic computer resources described in suitable operating environment 1810. Such software includes an operating system 1828. Operating system 1828, which can be stored on disk storage

1824, acts to control and allocate resources of the computer 1812. System applications 1830 take advantage of the management of resources by operating system 1828 through program modules 1832 and program data 1834 stored either in system memory 1816 or on disk storage 1824. It is to be appreciated that one or more embodiments of the subject disclosure can be implemented with various operating systems or combinations of operating systems.

A user enters commands or information into the computer 1812 through input device(s) 1836. Input devices 1836 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1814 through the system bus 1818 via interface port(s) 1838. Interface port(s) 1838 include, for example, a serial port, a parallel port, a game port, and a universal serial bus (USB). Output device(s) 1840 use some of the same type of ports as input device(s) 1836. Thus, for example, a USB port may be used to provide input to computer 1812, and to output information from computer 1812 to an output device 1840. Output adapters 1842 are provided to illustrate that there are some output devices 1840 like monitors, speakers, and printers, among other output devices 1840, which require special adapters. The output adapters 1842 include, by way of illustration and not limitation, video and sound cards that provide a means of connection between the output device 1840 and the system bus 1818. It should be noted that other devices and/or systems of devices provide both input and output capabilities such as remote computer(s) 1844.

Computer 1812 can operate in a networked environment using logical connections to one or more remote computers, such as remote computer(s) 1844. The remote computer(s) 1844 can be a personal computer, a server, a router, a network PC, a workstation, a microprocessor based appliance, a peer device or other common network node and the like, and typically includes many or all of the elements described relative to computer 1812. For purposes of brevity, only a memory storage device 1846 is illustrated with remote computer(s) 1844. Remote computer(s) 1844 is logically connected to computer 1812 through a network interface 1848 and then physically connected via communication connection 1850. Network interface 1848 encompasses communication networks such as local-area networks (LAN) and wide-area networks (WAN). LAN technologies include Fiber Distributed Data Interface (FDDI), Copper Distributed Data Interface (CDDI), Ethernet/IEEE 802.3, Token Ring/IEEE 802.5 and the like. WAN technologies include, but are not limited to, point-to-point links, circuit switching networks like Integrated Services Digital Networks (ISDN) and variations thereon, packet switching networks, and Digital Subscriber Lines (DSL). Network interface 1848 can also encompass near field communication (NFC) or Bluetooth communication.

Communication connection(s) 1850 refers to the hardware/software employed to connect the network interface 1848 to the system bus 1818. While communication connection 1850 is shown for illustrative clarity inside computer 1812, it can also be external to computer 1812. The hardware/software necessary for connection to the network interface 1848 includes, for exemplary purposes only, internal and external technologies such as, modems including regular telephone grade modems, cable modems and DSL modems, ISDN adapters, and Ethernet cards.

FIG. 19 is a schematic block diagram of a sample computing environment 1900 with which the disclosed subject matter can interact. The sample computing environment 1900 includes one or more client(s) 1902. The client(s) 1902 can be hardware and/or software (e.g., threads, processes, computing devices). The sample computing environment 1900 also includes one or more server(s) 804. The server(s) 1904 can also be hardware and/or software (e.g., threads, processes, computing devices). The servers 1904 can house threads to perform transformations by employing one or more embodiments as described herein, for example. One possible communication between a client 1902 and servers 1904 can be in the form of a data packet adapted to be transmitted between two or more computer processes. The sample computing environment 1900 includes a communication framework 1906 that can be employed to facilitate communications between the client(s) 1902 and the server(s) 1904. The client(s) 1902 are operably connected to one or more client data store(s) 1908 that can be employed to store information local to the client(s) 1902. Similarly, the server(s) 1904 are operably connected to one or more server data store(s) 1910 that can be employed to store information local to the servers 1904.

What has been described above includes examples of the subject innovation. It is, of course, not possible to describe every conceivable combination of components or methodologies for purposes of describing the disclosed subject matter, but one of ordinary skill in the art may recognize that many further combinations and permutations of the subject innovation are possible. Accordingly, the disclosed subject matter is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the disclosed subject matter. In this regard, it will also be recognized that the disclosed subject matter includes a system as well as a computer-readable medium having computer-executable instructions for performing the acts and/or events of the various methods of the disclosed subject matter.

In addition, while a particular feature of the disclosed subject matter may have been disclosed with respect to only one of several implementations, such feature may be combined with one or more other features of the other implementations as may be desired and advantageous for any given or particular application. Furthermore, to the extent that the terms "includes," and "including" and variants thereof are used in either the detailed description or the claims, these terms are intended to be inclusive in a manner similar to the term "comprising."

In this application, the word "exemplary" is used to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips . . . ), optical disks [e.g., compact disk (CD), digital versatile disk (DVD) . . . ], smart cards, and flash memory devices (e.g., card, stick, key drive . . . ).

What is claimed is:

1. An industrial device, comprising:

a memory that stores executable components; and a processor, operatively coupled to the memory, that executes the executable components, the executable components comprising:

a program execution component configured to execute an industrial control program;

a tag database component configured to maintain controller tags referenced by the industrial control program, wherein a controller tag of the controller tags is linked to an alarm condition such that one or more properties of the alarm condition are programmatically accessible extensions of the controller tag that are modifiable by the industrial control program; and an alarm processing component configured to, in response to receipt of alarm configuration data, define an alarm set that includes multiple alarm conditions specified by the alarm configuration data, and in response to receipt of a group alarm operation directed to the alarm set, apply the group alarm operation to the multiple alarm conditions included in the alarm set.

2. The industrial device of claim 1, wherein the group alarm operation is at least one of an acknowledge operation, a suppress command, an unsuppress command, an shelve command, an unshelve command, a disable command, an enable command, or a reset command.

3. The industrial device of claim 1, wherein the alarm processing component is further configured to generate rollup information for the multiple alarm conditions included in the alarm set and to render the rollup information accessible to an external application and to the industrial control program, and the rollup information comprises aggregated statistics for the multiple alarm conditions included in the alarm set.

4. The industrial device of claim 3, wherein the rollup information comprises at least one of an indication of a number of the multiple alarm conditions that are currently active, a number of the multiple alarm conditions that are currently unacknowledged, an identity of a most severe active alarm condition of the multiple alarm conditions, or a number of the multiple alarm conditions that are in a defined state.

5. The industrial device of claim 1, wherein the alarm condition is associated with a data type of the controller tag, and the alarm processing component is further configured to, in response to receiving a modification to the alarm condition, apply the modification to instances of the alarm condition associated with a respective subset of the controller tags that correspond to the data type, and in response to creation of a new controller tag that is an instance of the data type, associate the alarm condition to the new data tag.

6. The industrial device of claim 1, wherein the alarm condition is a function of a value of the controller tag, and the alarm processing component is further configured to, in response to a determination that the value of the controller tag satisfies the alarm condition, generate an alarm notification based on the association.

7. The industrial device of claim 6, wherein the alarm processing component is configured to execute on a first execution thread that is different than a second execution thread that executes the industrial control program.

8. The industrial device of claim 1, wherein the one or more properties comprise at least one of an alarm state, a high limit setpoint value, a low limit setpoint value, an ON delay property, an OFF delay property, an enable property, a disable property, an acknowledge property, or a severity level of the alarm condition.

9. The industrial device of claim 1, wherein the industrial device is at least one of an industrial controller or a motor drive.

10. The industrial device of claim 1, wherein at least one of the one or more properties is a disable property that prevents evaluation of the alarm condition while set, and the alarm processing component is configured to change a state of the disable property in accordance with an instruction generated by the industrial control program or a command received via a human-machine interface device.

11. A method for evaluating industrial alarms, comprising:

defining, by an industrial device comprising a processor, an association between an alarm condition and a controller tag of a set of controller tags defined on the industrial device, wherein the defining the association comprises setting one or more properties of the alarm condition to be extended members of the controller tag that are permitted to be modified by an industrial control program executed by the industrial device;

receiving, by the industrial device, alarm set definition data that identifies multiple alarm conditions, including the alarm condition, that are to be grouped into an alarm set;

in response to the receiving, defining, by the industrial device, the alarm set to include the multiple alarm conditions identified by the alarm set definition data; and in response to receiving a group alarm operation directed to the alarm set, executing, by the industrial device based on the alarm set definition data, the group alarm operation on the multiple alarm conditions included in the alarm set.

12. The method of claim 11, wherein the receiving the group alarm operation comprises receiving at least one of an acknowledge operation, a suppress command, an unsuppress command, an shelve command, an unshelve command, a disable command, an enable command, or a reset command.

13. The method of claim 11, further comprising:

generating, by the industrial device based on the alarm set definition data, alarm rollup information for the multiple alarm conditions included in the alarm set, the alarm rollup information comprising aggregated statistics for the multiple alarm conditions included in the alarm set; and rendering, by the industrial device, the alarm rollup information accessible to an external application and to the industrial control program.

14. The method of claim 13, wherein the rollup information comprises at least one of an indication of a number of the multiple alarm conditions that are currently active, a number of the multiple alarm conditions that are currently unacknowledged, an identity of a most severe active alarm condition of the multiple alarm conditions, or a number of the multiple alarm conditions that are in a defined state.

15. The method of claim 11, wherein the alarm condition is associated with subset of the controller tags corresponding to a specified data type, and the method further comprises:

in response to receiving a modification to the alarm condition, applying, by the industrial device, the modification to instances of the alarm condition associated with the subset of the controller tags that correspond to the data type, and in response to creation of a new controller tag that is an instance of the data type, associating, by the industrial device, the alarm condition to the new data tag.

16. The method of claim 11, wherein the one or more properties of the alarm condition comprise at least one of an alarm state, a high limit setpoint value, a low limit setpoint value, an ON delay property, an OFF delay property, an enable property, a disable property, an acknowledge property, or a severity level of the alarm condition.

17. The method of claim 11, wherein the one or more properties comprise at least a disable property that disables evaluation of the alarm condition while set, and the method further comprises changing, by the industrial device, a state of the disable property in accordance with an instruction generated by the industrial control program or a command received via a human-machine interface device.

18. The method of claim 11, wherein the defining the association further comprises setting the alarm condition to be a function of a value of the controller tag, and the method further comprises, in response to determining that the value of the controller tag satisfies the alarm condition, generating, by the industrial device, an alarm notification in accordance with the association, wherein the alarm notification is accessible to an external application.

19. A non-transitory computer-readable medium having stored thereon instructions that, in response to execution, cause an industrial device comprising a processor to perform operations, the operations comprising:

establishing an association between an alarm condition and a controller tag of a set of controller tags defined on the industrial device, wherein the establishing the association comprises setting one or more properties of the alarm condition to be extended members of the controller tag that are modifiable by an industrial control program executed by the industrial device;

receiving alarm set definition data that identifies multiple alarm conditions, including the alarm condition, to be grouped into an alarm set;

in response to the receiving, defining the alarm set to include the multiple alarm conditions identified by the alarm set definition data; and in response to receiving a group alarm operation directed to the alarm set, executing the group alarm operation on the multiple alarm conditions included in the alarm set based on the alarm set definition data.

20. The non-transitory computer-readable medium of claim 19, wherein the receiving the group alarm operation comprises receiving at least one of an acknowledge operation, a suppress command, an unsuppress command, an shelve command, an unshelve command, a disable command, an enable command, or a reset command.

* * * * *